US011339541B2

(12) United States Patent
Wenzelmann et al.

(10) Patent No.: US 11,339,541 B2
(45) Date of Patent: May 24, 2022

(54) ADJUSTABLE WIDTH MOLD

(71) Applicant: Wirtgen GmbH, Windhagen (DE)

(72) Inventors: Harry Wenzelmann, Alpenrod (DE); Winfried von Schönebeck, Kalenborn (DE); Michael Engels, Montabaur (DE)

(73) Assignee: Wirtgen GmbH

( * ) Notice: Subject to any disclaimer, the term of this patent is extended or adjusted under 35 U.S.C. 154(b) by 112 days.

(21) Appl. No.: 17/075,487

(22) Filed: Oct. 20, 2020

(65) Prior Publication Data

US 2021/0172131 A1 Jun. 10, 2021

Related U.S. Application Data

(63) Continuation-in-part of application No. 16/809,871, filed on Mar. 5, 2020, now Pat. No. 11,162,233.

(60) Provisional application No. 62/944,011, filed on Dec. 5, 2019.

(51) Int. Cl.
*E01C 19/48* (2006.01)

(52) U.S. Cl.
CPC ..... *E01C 19/4893* (2013.01); *E01C 2301/16* (2013.01)

(58) Field of Classification Search
CPC ... E01C 19/48; E01C 19/4893; E01C 2301/16
USPC ..... 404/72–118
See application file for complete search history.

(56) References Cited

U.S. PATENT DOCUMENTS 1,782,707 A 11/1930 Bayley
3,970,405 A 7/1976 Swisher, Jr. et al.
4,197,032 A 4/1980 Miller
4,379,653 A 4/1983 Brown
4,586,889 A 5/1986 Krohne et al.
4,678,365 A 7/1987 Ban et al.
4,778,305 A 10/1988 Ritchey et al.
4,789,266 A 12/1988 Clarke et al.
4,900,186 A 2/1990 Swisher et al.
(Continued)

FOREIGN PATENT DOCUMENTS

DE 19814052 A1 10/1999
DE 10223721 A1 * 5/2002 ..... E01C 19/48
(Continued)

OTHER PUBLICATIONS

CMI 2000 Series HVW Hydraulic Variable-Width Slipform Pavers brochure, CMI Corporation, Oklahoma City U.S.A., 6 pages (dated at least as early as Apr. 8, 2001).
(Continued)

*Primary Examiner* — Raymond W Addie
(74) *Attorney, Agent, or Firm* — Lucian Wayne Beavers; Patterson Intellectual Property Law, PC

(57) ABSTRACT

An adjustable width mold apparatus for a slipform paver includes a center portion and left and right sideform assemblies. The center portion has left and right lateral ends. Left and right adjustable width support assemblies are connected between the sideform assemblies and the center portion. One or more spacers may be received between each sideform assembly and the center portion to adjust the width of the mold apparatus. The spacers may be hung on a plurality of hanger rods. Each of the hanger rods may have a hydraulic nut on one end thereof for clamping the spacers between the sideform assembly and the center portion.

24 Claims, 31 Drawing Sheets

(56) References Cited

U.S. PATENT DOCUMENTS

| | | | |
|---|---|---|---|
| 5,590,977 | A | 1/1997 | Guntert et al. |
| 5,615,972 | A | 4/1997 | Guntert et al. |
| 5,647,688 | A | 7/1997 | Guntert et al. |
| 5,941,658 | A | 8/1999 | Dahlinger et al. |
| 6,022,170 | A | 2/2000 | Rower |
| 6,390,728 | B1 | 5/2002 | Casters |
| 6,471,442 | B1 | 10/2002 | Deeb et al. |
| 6,497,531 | B2 | 12/2002 | Sipherd et al. |
| 6,582,152 | B2 | 6/2003 | Leone et al. |
| 6,872,028 | B2 | 3/2005 | Aeschlimann et al. |
| 6,890,123 | B2 | 5/2005 | Piccoli |
| 7,651,295 | B2 | 1/2010 | Eppes et al. |
| 7,950,874 | B2 | 5/2011 | Guntert, Jr. et al. |
| 8,267,619 | B2 | 9/2012 | Munz |
| 8,967,908 | B1 | 3/2015 | Thieme et al. |
| 9,121,141 | B2 | 9/2015 | Thieme et al. |
| 2003/0185626 | A1 | 10/2003 | Aeschlimann et al. |
| 2010/0266339 | A1 | 10/2010 | Guntert, Jr. et al. |

FOREIGN PATENT DOCUMENTS

| | | | |
|---|---|---|---|
| EP | 1213389 | A1 | 6/2002 |
| WO | 9528525 | A1 | 10/1995 |
| WO | 9704176 | A1 | 2/1997 |
| WO | 9950503 | A1 | 10/1999 |
| WO | 02101150 | A1 | 12/2002 |
| WO | 2010120722 | A1 | 10/2010 |

OTHER PUBLICATIONS

CMI 2000 Series Paving Kit Arrangements brochure, CMI Corporation, P.O. Box 1985, Oklahoma City, OK 73101 USA, 2 pages (dated at least as early as Apr. 8, 2001).

CMI 2000 Series HVW Models SF-2103, SF-2104 and SF-2204 brochure, CMI Corporation U.S.A., P.O. Box 1985, Oklahoma City, OK 73101, 16 pages (dated at least as early as Apr. 8, 2001).

Corresponding Co Pending U.S. Appl. No. 16/809,871, filed Mar. 5, 2020, 50 pages (not prior art).

* cited by examiner

ADJUSTABLE WIDTH MOLD

BACKGROUND OF THE INVENTION

1. Field of the Invention

The present application relates to a slipform paver, and more specifically to an adjustable width mold apparatus for a slipform paver.

2. Description of the Prior Art

A slipform paving machine is designed to move in a paving direction across a ground surface and form concrete into a finished concrete structure. A typical slipform paver machine may be seen in U.S. Pat. No. 6,872,028 (WO 2002/101150) to Aeschlimann et al. Machines like that of Aeschlimann et al. are adjustable in width.

It is also known to provide adjustable width molds for use with adjustable width paving machines. Examples of such adjustable width molds may be seen in Guntert U.S. Pat. No. 7,950,874 and Thieme U.S. Pat. No. 9,121,141.

There is a continuing need for improvements in such adjustable width molds.

SUMMARY OF THE INVENTION

In one embodiment an adjustable width mold apparatus for a slipform paver includes a center portion and left and right sideform assemblies. A left adjustable width support assembly is connected between the left sideform assembly and the center portion. A left actuator extends and retracts the left adjustable width support assembly. A right adjustable width support assembly is connected between the right sideform assembly and the center portion. A right actuator extends and retracts the right adjustable width support assembly. A plurality of left side hanger rods extend between the left sideform assembly and the center portion. One or more left side spacers are configured to be received on the left side hanger rods between the left sideform assembly and the center portion. A plurality of hydraulic nuts are each attached to a respective one of the hanger rods and configured to apply a clamping force to clamp the one or more left side spacers between the left sideform assembly and the center portion.

The plurality of left side hanger rods may include a forward upper hanger rod, a forward lower hanger rod, a rearward upper hanger rod and a rearward lower hanger rod.

In any of the above embodiments each of the hanger rods may include a plurality of anchoring structures equally spaced at a spacing interval along a length of the hanger rod.

In any of the above embodiments each of the one or more left side spacers may have a spacer width equal to a whole number multiple of the spacing interval.

In any of the above embodiments each of the anchoring structures may include a pair of diametrically opposed notches formed in the respective hanger rod.

In any of the above embodiments each of the hydraulic nuts may include a nut anchor configured to be engaged with one of the anchoring structures of the respective hanger rod.

In any of the above embodiments an end anchor may be engaged with one of the anchoring structures of each hanger rod.

In any of the above embodiments each of the hydraulic nuts may include a manual lock nut configured to lock the hydraulic nut in a clamped position so that hydraulic pressure to the hydraulic nut can be released while maintaining the hydraulic nut in the clamped position.

In any of the above embodiments the left adjustable width support assembly may include an I-beam fixedly connected to one of the left sideform assembly and the center portion, and a plurality of roller guides mounted on the other of the left sideform assembly and the center portion. The I-beam is slidingly received by the plurality of roller guides.

In any of the above embodiments the I-beam may be fixedly connected to the left sideform assembly and the plurality of roller guides may be mounted on the center portion.

In any of the above embodiments the center portion may terminate in left and right lateral ends. The left adjustable width support assembly may include a plurality of separate roller guide mounting bases mounted on the left lateral end of the center portion. Each of the roller guides may be mounted on one of the roller guide mounting bases. A laterally innermost one of the one or more left spacers may surround the roller guide mounting bases such that the laterally innermost one of the one or more left spacers is held directly against the left lateral end of the center portion.

In any of the above embodiments each of the roller guide mounting bases of the left adjustable width support assembly may extend laterally inward of the left lateral end of the center portion into the center portion.

In any of the above embodiments the left adjustable width support assembly may be configured such that when no spacers are present and the left actuator is retracted such that the left sideform assembly is pulled into engagement with the left lateral end of the center portion the I-beam extends through the left lateral end of the center portion into the center portion.

In any of the above embodiments the I-beam may include a top flange, a bottom flange, and a vertical central web joining the top flange and the bottom flange. The plurality of roller guides may include an outer roller guide engaging an outer surface of one of the top and bottom flanges directly in line with the vertical central web, and the first and second inner roller guides may engage inner surfaces of the one of the top and bottom flanges. The first and second inner roller guides are located on opposite sides of the vertical central web.

In any of the above embodiments the left actuator may be a rotary spindle actuator including a left rotary spindle connected to one of the left sideform assembly and the center portion, and a left spindle nut connected directly or indirectly to the other of the left sideform assembly and the center portion. The left rotary spindle may be received in the left spindle nut.

In another embodiment a method of adjusting a width of a mold apparatus of a slipform paver may be described as comprising steps of:

(a) extending a linear actuator to extend a sideform assembly away from a center portion of the mold apparatus thereby providing a space between the sideform assembly and the center portion;

(b) placing one or more spacers in the space between the sideform assembly and the center portion;

(c) retracting the linear actuator and thereby moving the sideform assembly toward the center portion of the mold apparatus and reducing the space between the sideform assembly and the center portion; and (d) clamping the one or more spacers between the sideform assembly and the center portion by applying hydraulic pressure to a plurality of hydraulic nuts attached to a plurality of tensioning rods extending between the sideform assembly and the center portion thereby tensioning the tension rods The method may further include after step (d), tightening a mechanical lock nut on each of the hydraulic nuts to hold a final tensioning force on each of the tensioning rods.

Any of the above methods may include after the tightening step, releasing hydraulic pressure from the hydraulic nuts.

Any of the above methods may include in step (a) the linear actuator being a hydraulic actuator.

Any of the above methods may include hydraulically releasing the hydraulic actuator.

Any of the above methods may include in step (a), the linear actuator being a rotary spindle actuator including a rotary spindle connected to one of the sideform assembly and the center portion, and a spindle nut connected to the other of the sideform assembly and the center portion.

Any of the above methods may include in step (a) the center portion terminating in left and right lateral ends. In step (a) the sideform assembly may be at least partially supported by an adjustable width support assembly extending through one of the lateral ends of the center portion. In step (d) a laterally innermost one of the one or more spacers may be clamped directly against the one of the lateral ends of the center portion.

Any of the above methods may include in step (b) the one or more spacers being supported on the tensioning rods.

Any of the above methods may include in step (d) the plurality of tensioning rods including a forward upper hanger rod, a forward lower hanger rod, a rearward upper hanger rod and a rearward lower hanger rod.

One advantage of the present invention is provided by the use of the hydraulic nuts to provide precise control of the application of tension to the hanger/tensioning rods.

A further advantage is provided by the use of rotary spindle actuators which provide an especially fine control over the extension and retraction of the sideform assemblies.

Another advantage is provided by the dual function of the hanger/tensioning rods.

Numerous other objects, features and advantages of the embodiments set forth herein will be readily apparent to those skilled in the art upon reading of the following disclosure when taken in conjunction with the accompanying drawings.

DETAILED DESCRIPTION

Figure 1:
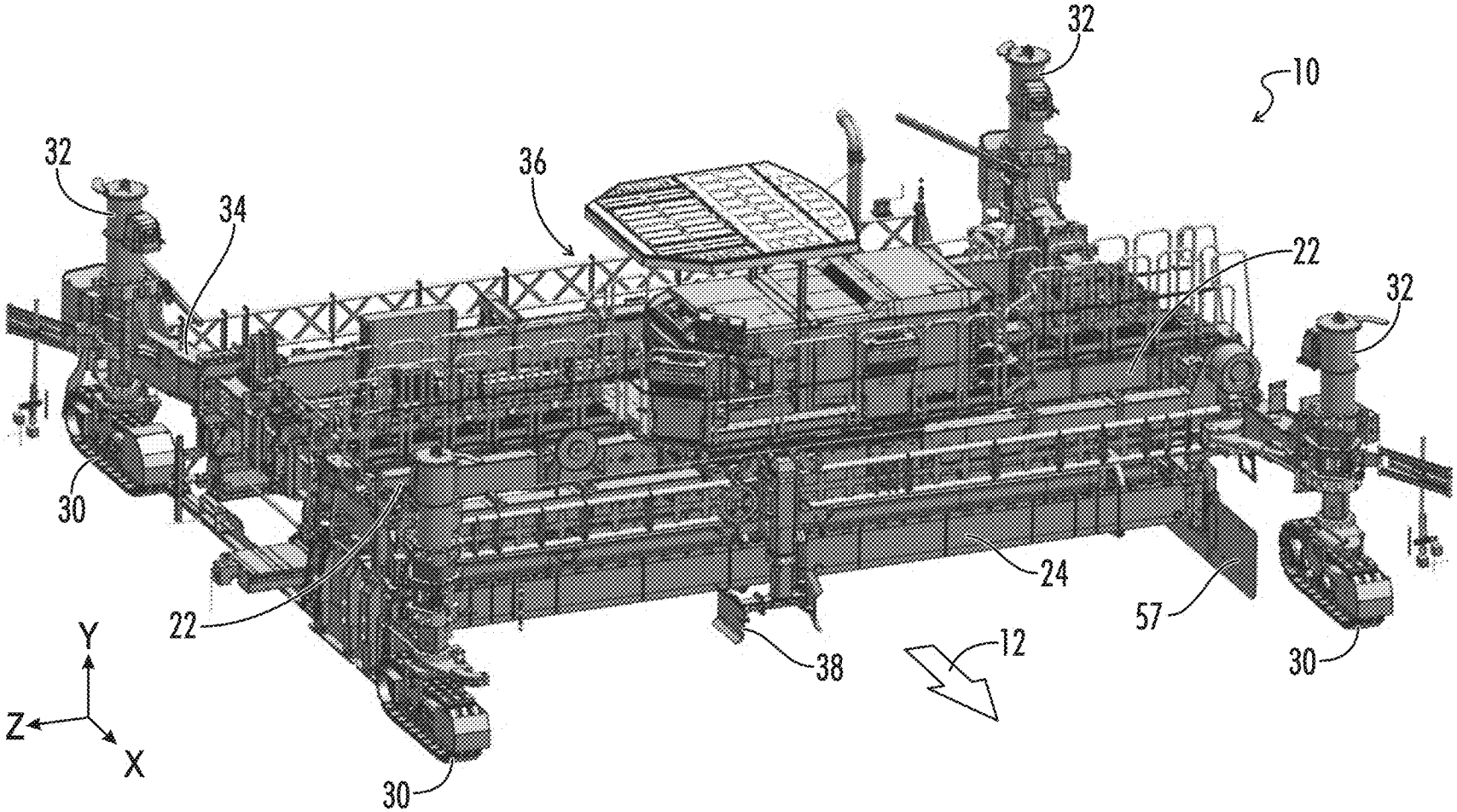
FIG. 1 is a front perspective view of a slipform paver including one embodiment of the adjustable width mold apparatus.
Figure 2:
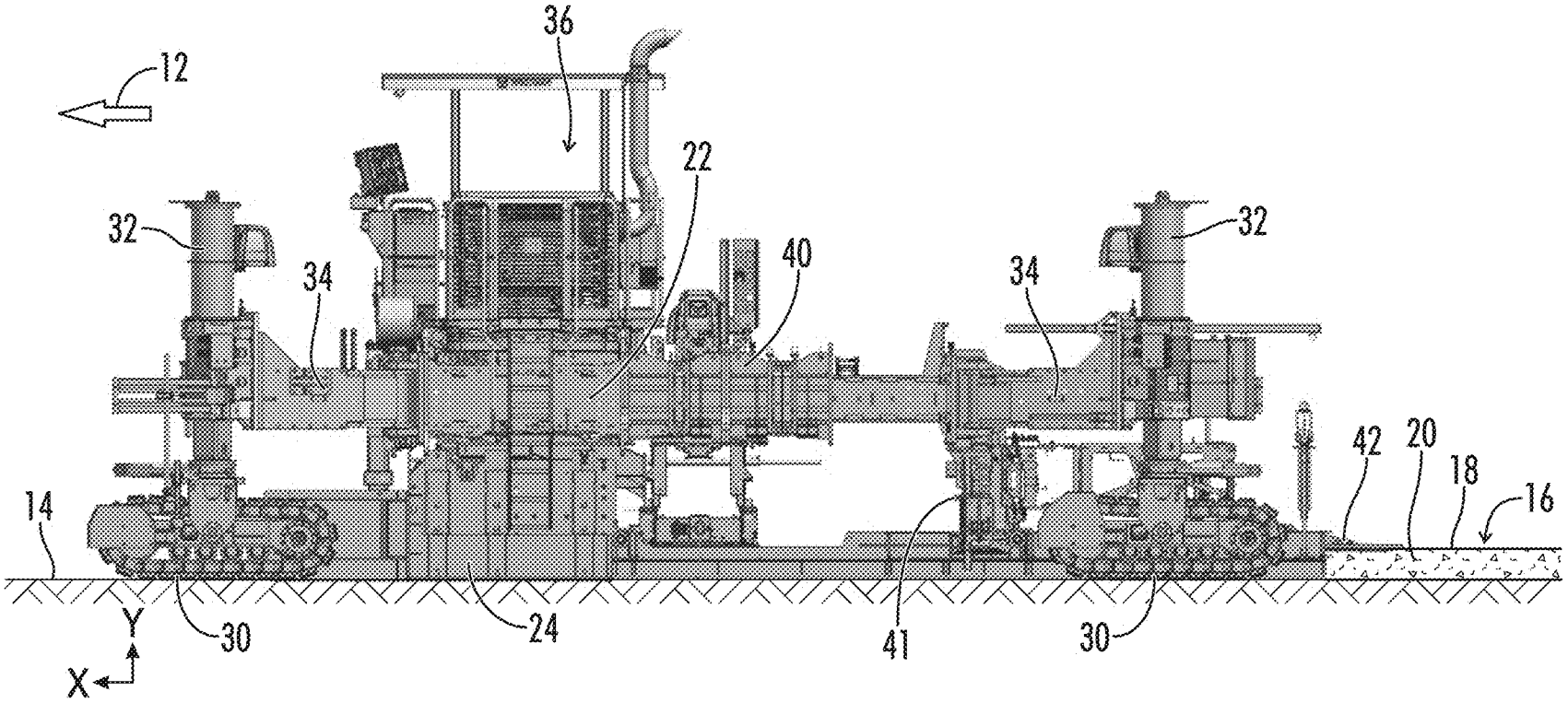
FIG. 2 is a left side elevation view of the slipform paver of FIG. 1.
Figure 3:
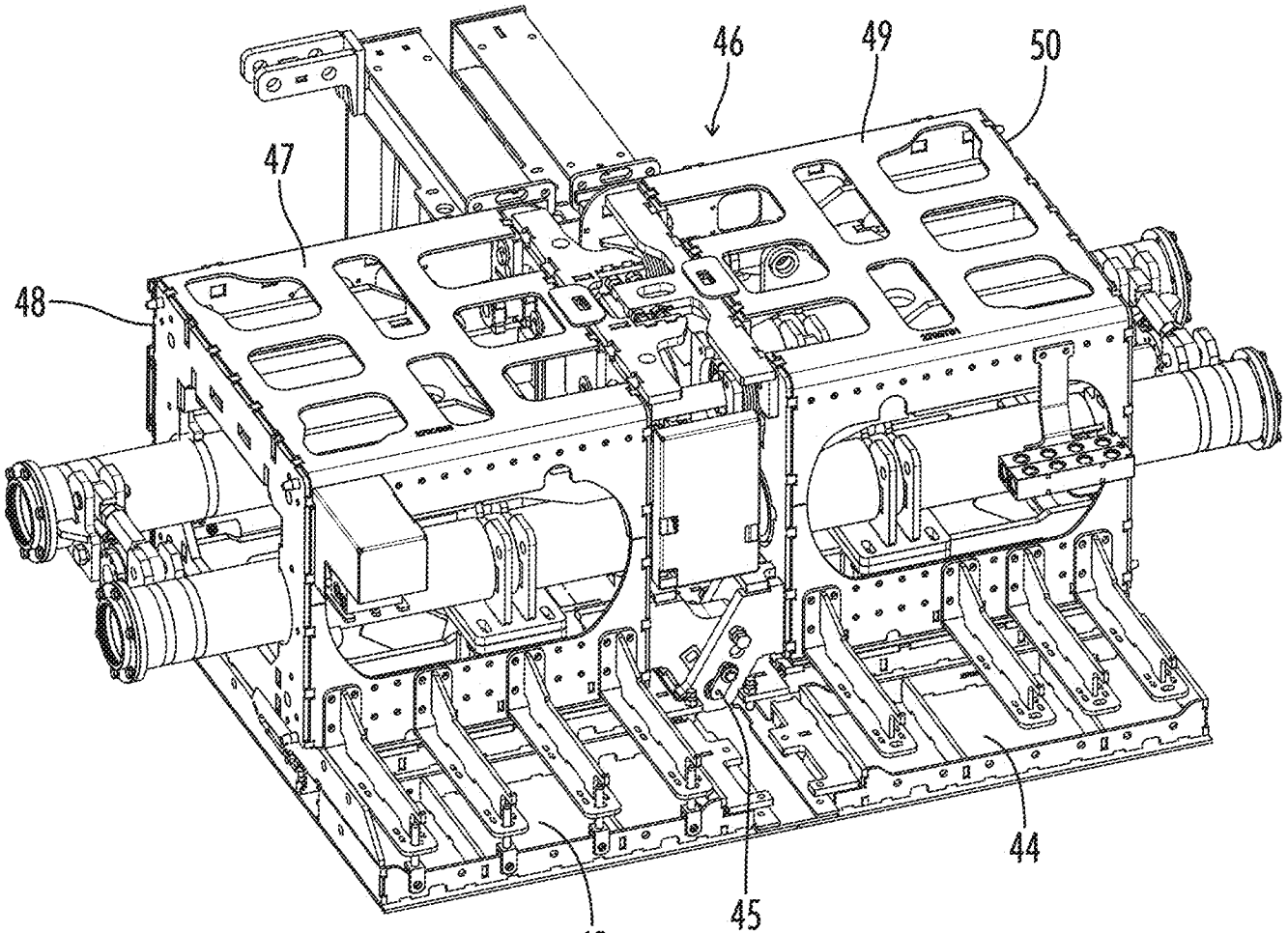
FIG. 3 is an enlarged view of the center portion of the adjustable width mold apparatus.

Referring now to the drawings, and particularly to FIGS. 1 and 2, a slipform paver apparatus is shown and generally designated by the number 10. The details of construction of a typical slipform paver apparatus may be seen in U.S. Pat. No. 6,872,028 (WO 2002/101150) to Aeschlimann et al., which is incorporated herein by reference.

As is schematically illustrated in FIGS. 1 and 2 the apparatus 10 is configured to move in a paving direction 12 across a ground surface 14 for spreading, leveling and finishing concrete into a finished concrete structure 16 having a generally upwardly exposed concrete surface 18 and terminating in lateral concrete sides such as 20.

The slipform paver apparatus 10 includes a main frame 22 and a slipform paver mold 24 supported from the main frame 22. The slipform paver mold 24 may be referred to as an adjustable width mold apparatus 24.

The main frame 22 is supported from the ground surface by a plurality of ground engaging units such as 30, which in the illustrated embodiment are tracked ground engaging units 30. Wheeled ground engaging units could also be used. Each of the ground engaging units 30 is connected to the main frame 22 by a lifting column such as 32 which may be attached to a swing arm such as 34. An operator's platform 36 is located on the main frame 22. A plow or spreader device 38 may be supported from the main frame 22 ahead of the slipform paver mold 24. Behind the slipform paver mold 24 a dowel bar inserter apparatus 40 may be provided. Behind the dowel bar inserter apparatus 40 an oscillating beam 41 and a super smoother apparatus 42 may be provided.

The main frame 22 includes a plurality of laterally telescoping frame members that allow the width of the main frame to be adjusted. The adjustment of the main frame width may be accomplished using hydraulic ram actuators embedded in the main frame, or the traction power of the ground engaging units 30 may be used to extend and retract the main frame 22. When the width of the main frame 22 is adjusted it may also be necessary to adjust the width of the mold apparatus 24.

Figure 4:
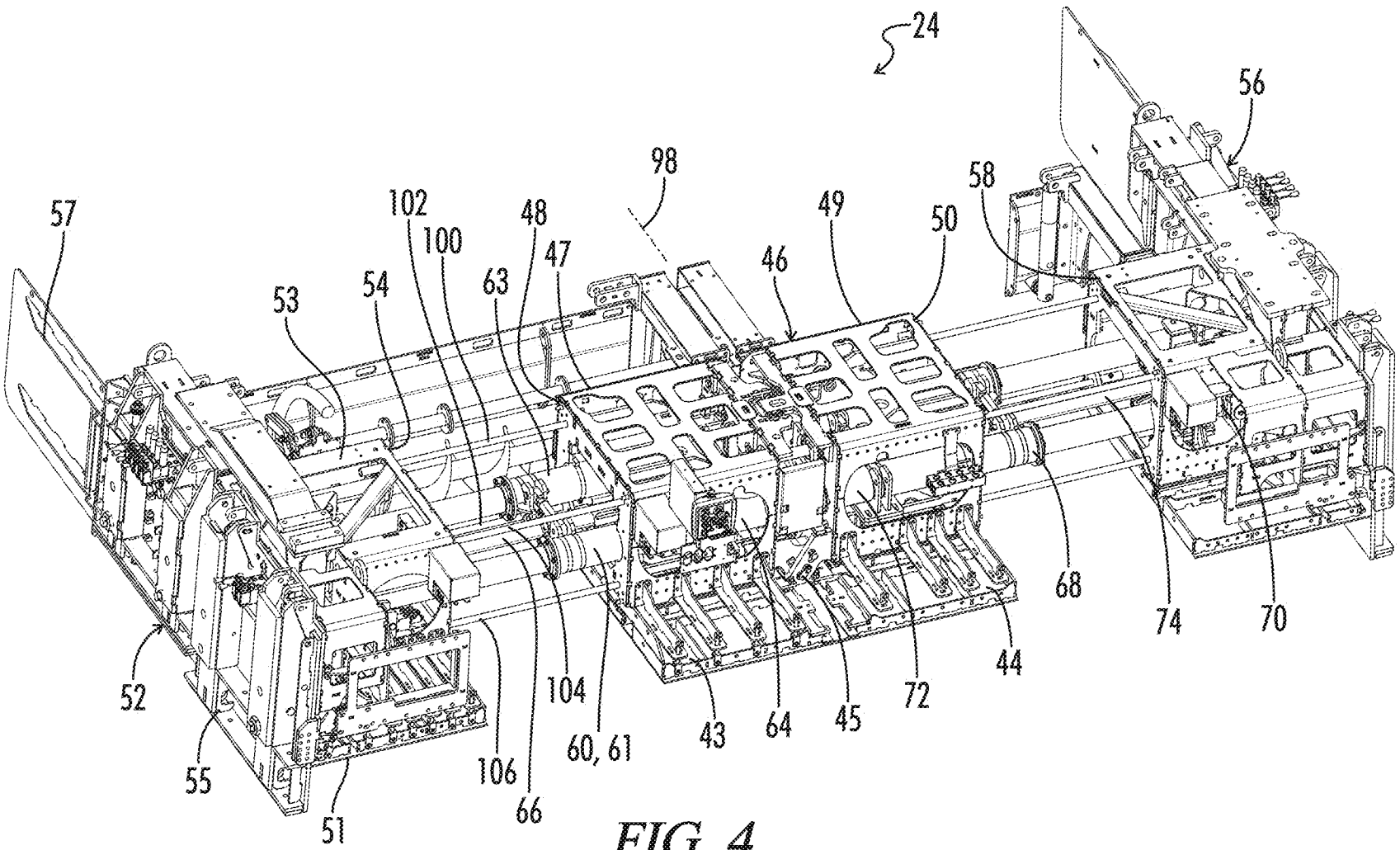
FIG. 4 is a rear left side perspective view of the adjustable width mold apparatus, with each of the sideform assemblies in an extended position providing a space to receive one or more spacers.
Figure 6:
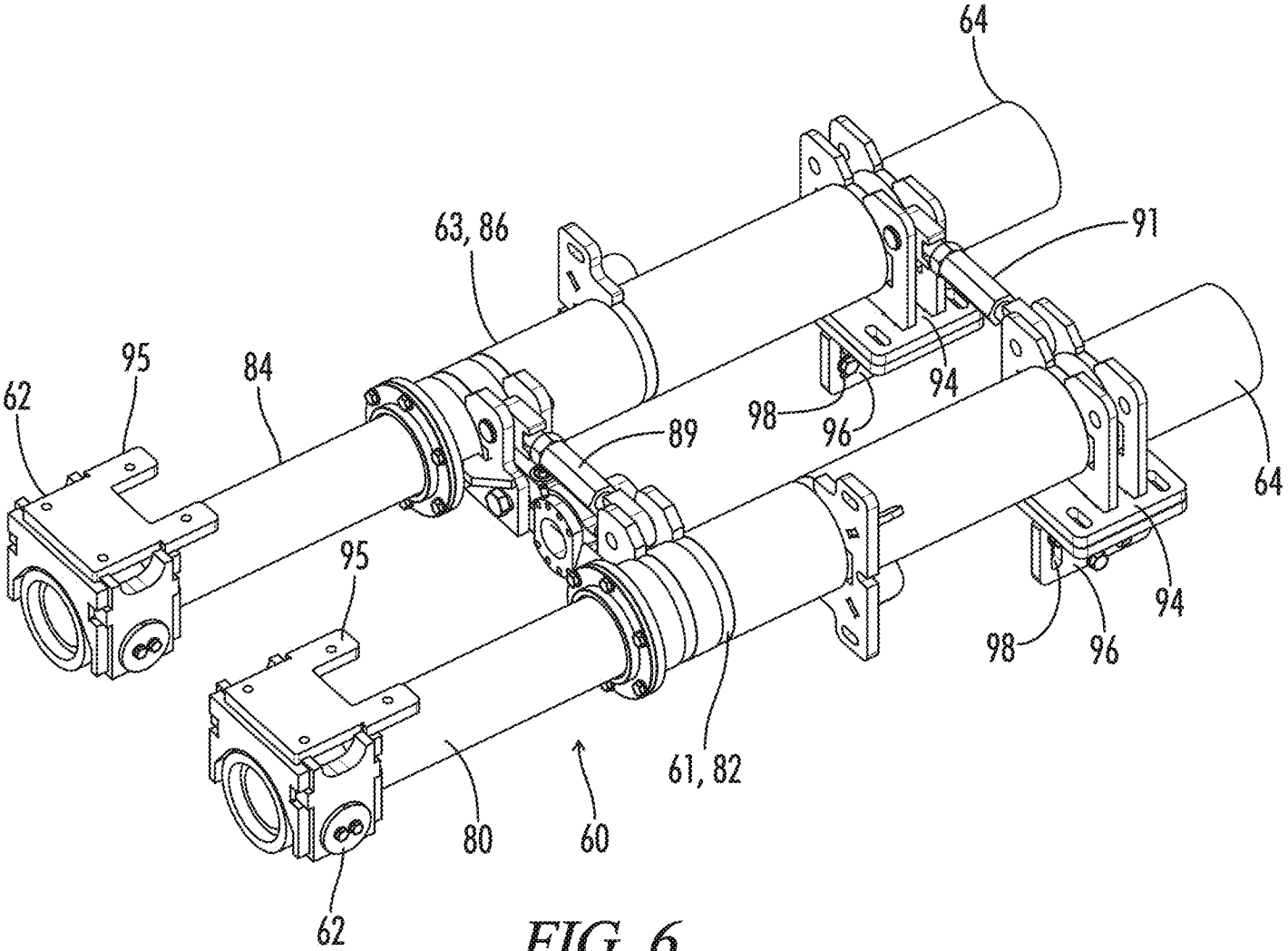
FIG. 6 is a perspective view of the left telescoping support assembly.

Referring now to FIGS. 4 and 6 the adjustable width mold apparatus 24 includes a center portion 46 terminating in left and right lateral ends 48 and 50. The center portion 46 may be of the type configured to allow the formation of a crown in the molded concrete structure 16. In such an embodiment, the center portion 46 includes a left center portion half 47 and a right center portion half 49 joined together by a pivoted connection 45 such that the left and right center portion halves 47 and 49 can be pivoted relative to each other to form a crown in the molded structure 16. Left and right center portion pan portions 43 and 44 are attached to the bottom of the left and right center portion halves 47 and 49 and define the center portion of the generally horizontal mold surface for forming the top surface 18 of the molded concrete structure 16.

The adjustable width mold apparatus 24 further includes a left sideform assembly 52 having a laterally inner end 54 and a right sideform assembly 56 having a laterally inner end 58.

The left sideform assembly 52 may include a sideform framework 53 on which the laterally inner end 54 is defined. A left sideform assembly pan portion 51 is attached to the bottom of the sideform framework 53 and defines the leftmost portion of the generally horizontal mold surface for forming the top surface 18 of the molded concrete structure 16. The left sideform assembly 52 may further include a left sideform 55 which extends vertically downward from the sideform framework 53 to seal the left end of the mold and thus to form the left wall 20 of the molded structure 16. A guide panel 57 may extend forward from the sideform 55 to guide the unformed concrete mixture into the mold. The right sideform assembly 56 is similarly constructed.

A left telescoping support assembly 60 is connected between the left sideform assembly 52 and the center portion 46. FIG. 4 shows the left telescoping support assembly 60 in place on the mold apparatus 24, and FIG. 6 shows the left telescoping support assembly 60 in isolation. The left telescoping support assembly 60 includes a laterally outer end 62 connected to the left sideform assembly 52 and a laterally inner end 64 connected to the center portion 46 laterally inward of the left lateral and 48. Preferably the laterally outer end 62 of the left telescoping support assembly 60 is connected to the left sideform assembly 52 laterally outward of the laterally inner end 54 of the left sideform assembly 52.

The laterally inner end 64 of the left telescoping support assembly 60 may be mounted upon the center portion 46 using horizontal mounting plates such as 94 and vertical mounting plates such as 96 extending downward from the horizontal plates 94. Holes 98 in the vertical mounting plates 96 may receive bolts (not shown) to fixedly attach the left telescoping support assembly 60 to the center portion 46 at a mounting location. The mounting location is preferably at least midway from the left lateral end 48 of the center portion 46 toward a lateral center 101 of the center portion 46.

Figure 7:
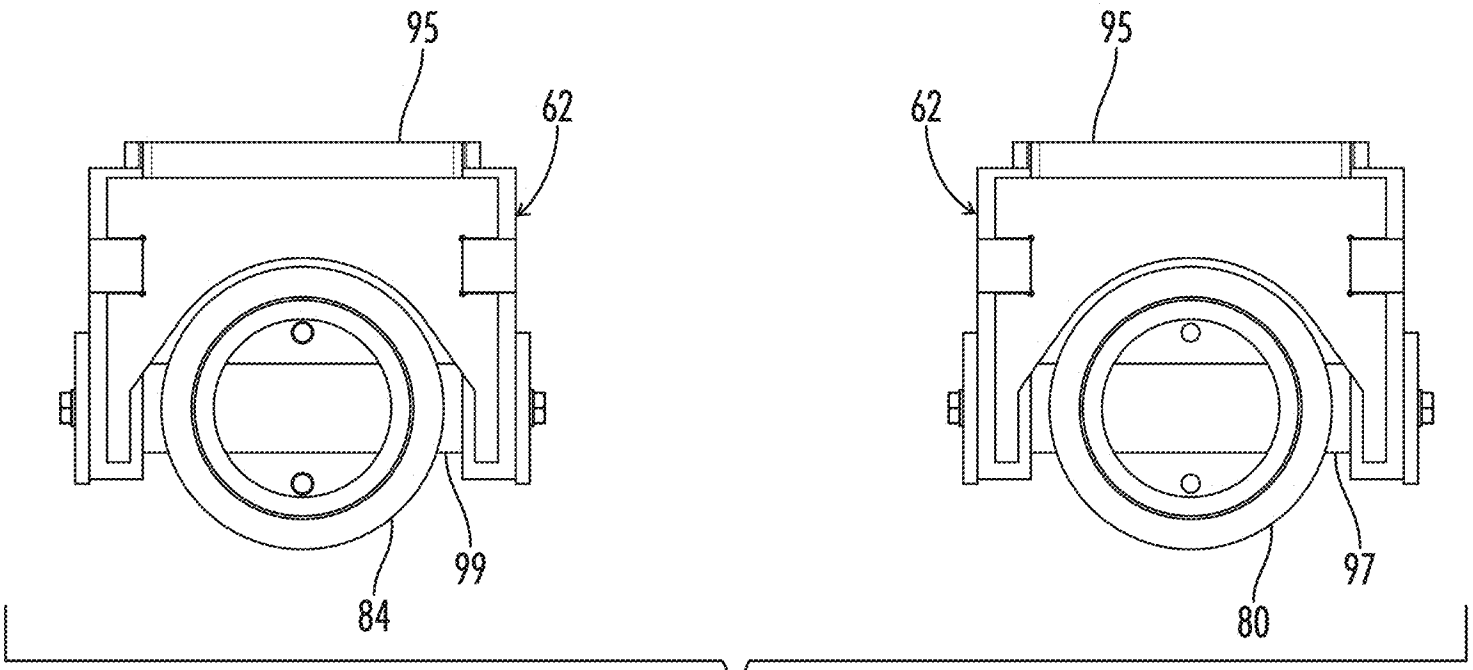
FIG. 7 is a laterally outer end view of the connecting portions of the left telescoping support assembly.

The laterally outer end 62 of the left telescoping support assembly 60 is mounted upon the left sideform assembly 52 using mounting flanges such as 95 which may be bolted to a corresponding surface on the left sideform assembly 52. FIG. 7 is a left end view of the laterally outer ends of the left telescoping support assembly 60. There it can be seen that the mounting flanges 95 are pivotally connected to their respective male tubes 80 and 84 via pivot pins 97 and 99.

The left telescoping support assembly 60 includes a left actuator 66 for extending and retracting the left telescoping support assembly 60 so as to move the left sideform assembly 52 away from or toward the center portion 46.

A right telescoping support assembly 68 similarly includes a laterally outer end 70 connected to the right sideform assembly 56 and a laterally inner end 72 connected to the center portion 46 laterally inward of the right lateral end 50. Preferably the laterally outer end 70 of the right telescoping support assembly 68 is connected to the right sideform assembly 56 laterally outward of the laterally inner end 58 of the right sideform assembly 56. The right telescoping support assembly 68 includes a right actuator 74 for extending and retracting the right telescoping support assembly 68. The extension of the left and right telescoping support assemblies can also be aided by use of the ground engaging units 30. The left and right telescoping support assemblies 60 and 68 may also be referred to as left and right adjustable width support assemblies 60 and 68.

Figure 5:
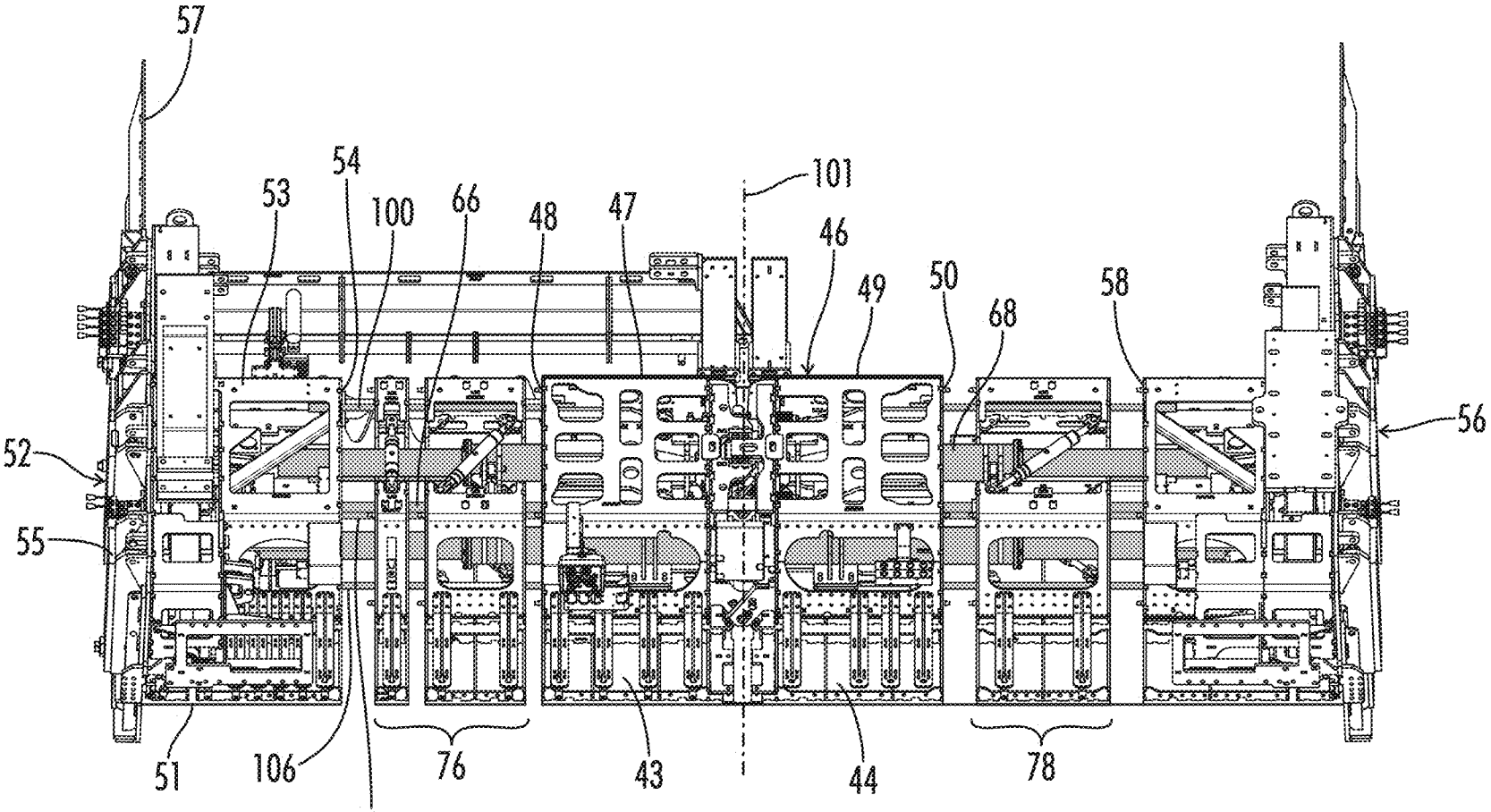
FIG. 5 is rear perspective view of the adjustable width mold apparatus of FIG. 4, showing two spacers inserted on the left side and one spacer inserted on the right side. The sideform assemblies have not yet been retracted to clamp the spacers in place.

As seen in FIG. 5 one or more left spacers 76 are configured to be received between the laterally inner end 54 of the left sideform assembly 52 and the left lateral end 48 of the center portion 46, such that upon retraction of the left telescoping support assembly 60 a laterally innermost one of the one or more left spacers 76 is held directly against the left lateral end 48 of the center portion 46. Similarly, upon retraction of the left telescoping support assembly 60 a laterally outermost one of the one or more left spacers 76 is held directly against the laterally inner end 54 of the left sideform assembly 52.

Similarly, one or more right spacers 78 are configured to be received between the laterally inner end 58 of the right sideform assembly 56 and the right lateral end 50 of the center portion 46, such that upon retraction of the right telescoping support assembly 68 a laterally innermost one of the one or more right spacers 78 is held directly against the right lateral end 50 of the center portion 46. Similarly, upon retraction of the right telescoping support assembly 68 a laterally outermost one of the one or more right spacers 78 is held directly against the laterally inner end 58 of the right sideform assembly 56.

The left telescoping support assembly 60 includes a rearward left telescoping tube assembly 61 and a forward left telescoping tube assembly 63. The forward left telescoping tube assembly 63 includes a male tube 84 connected to one of the left sideform assembly 52 and the center portion 46, and a female tube 86 connected to the other of the left sideform assembly 52 and the center portion 46. Similarly, the rearward left telescoping tube assembly 61 includes a male tube 80 connected to one of the left sideform assembly 52 and the center portion 46, and female tube 82 connected to the other of the left sideform assembly 52 and the center portion 46. Preferably it is the male tubes 80 and 84 which are connected to the left sideform assembly 52, and the female tubes 82 and 86 which are connected to the center portion 46.

Figure 8:
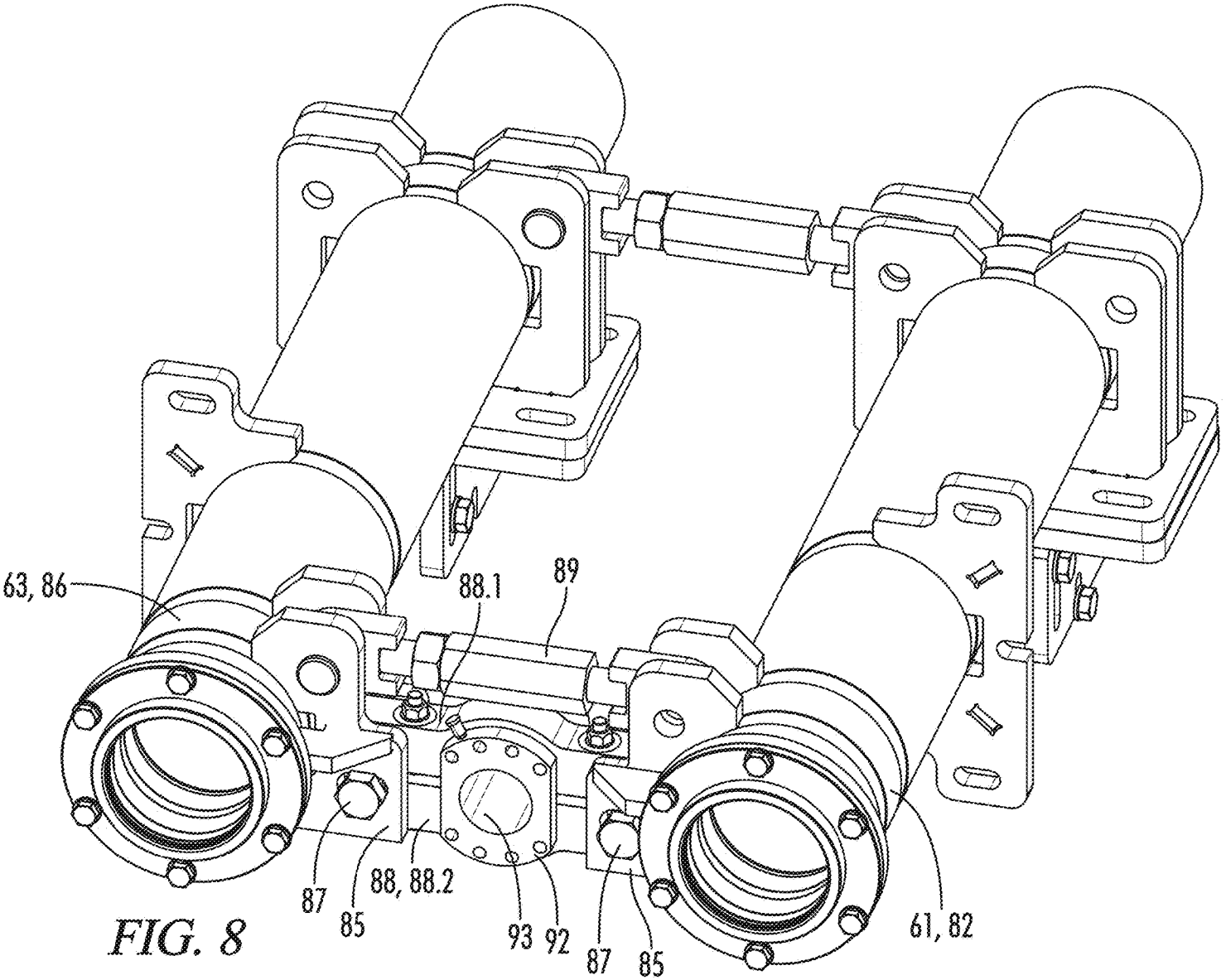
FIG. 8 is a perspective view of the laterally outer ends of the female tubes of the left telescoping support assembly, showing the bridge and the nut mounted in the bridge.

The left telescoping support assembly 60 further includes a bridge 88 best seen in FIG. 8. The bridge 88 structurally connects the female tubes 82 and 86 of the forward and rearward left telescoping tube assemblies 61 and 63. The bridge 88 may be attached to the female tubes 82 and 86 via bolts 87 extending through brackets 85 which are welded to the female tubes. The left telescoping support assembly 60 may further include first and second adjustable length connectors 89 and 91 extending between the female tubes 82 and 86 as seen in FIG. 6.

Figure 9:
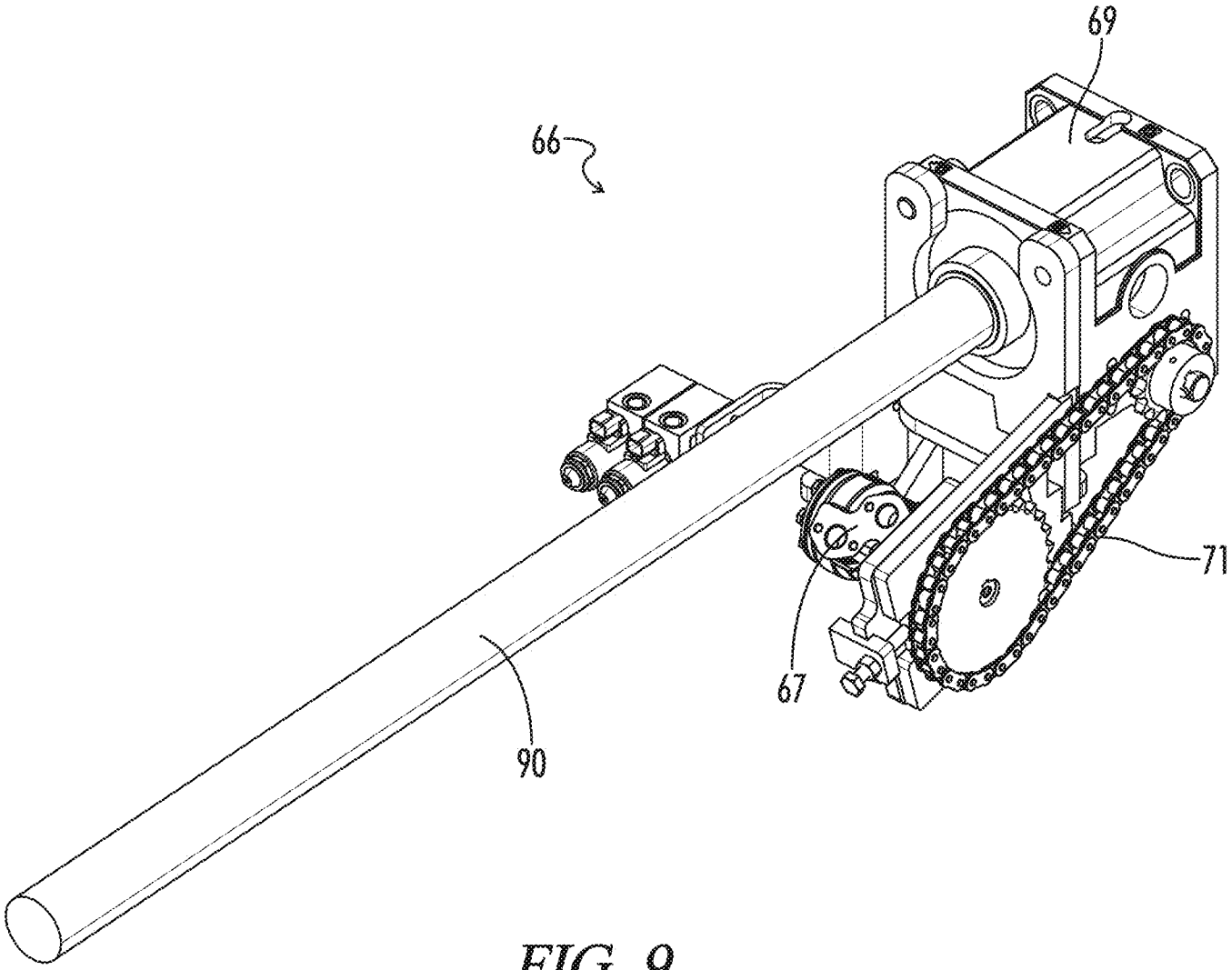
FIG. 9 is a perspective view of the left rotary spindle actuator.
Figure 10:
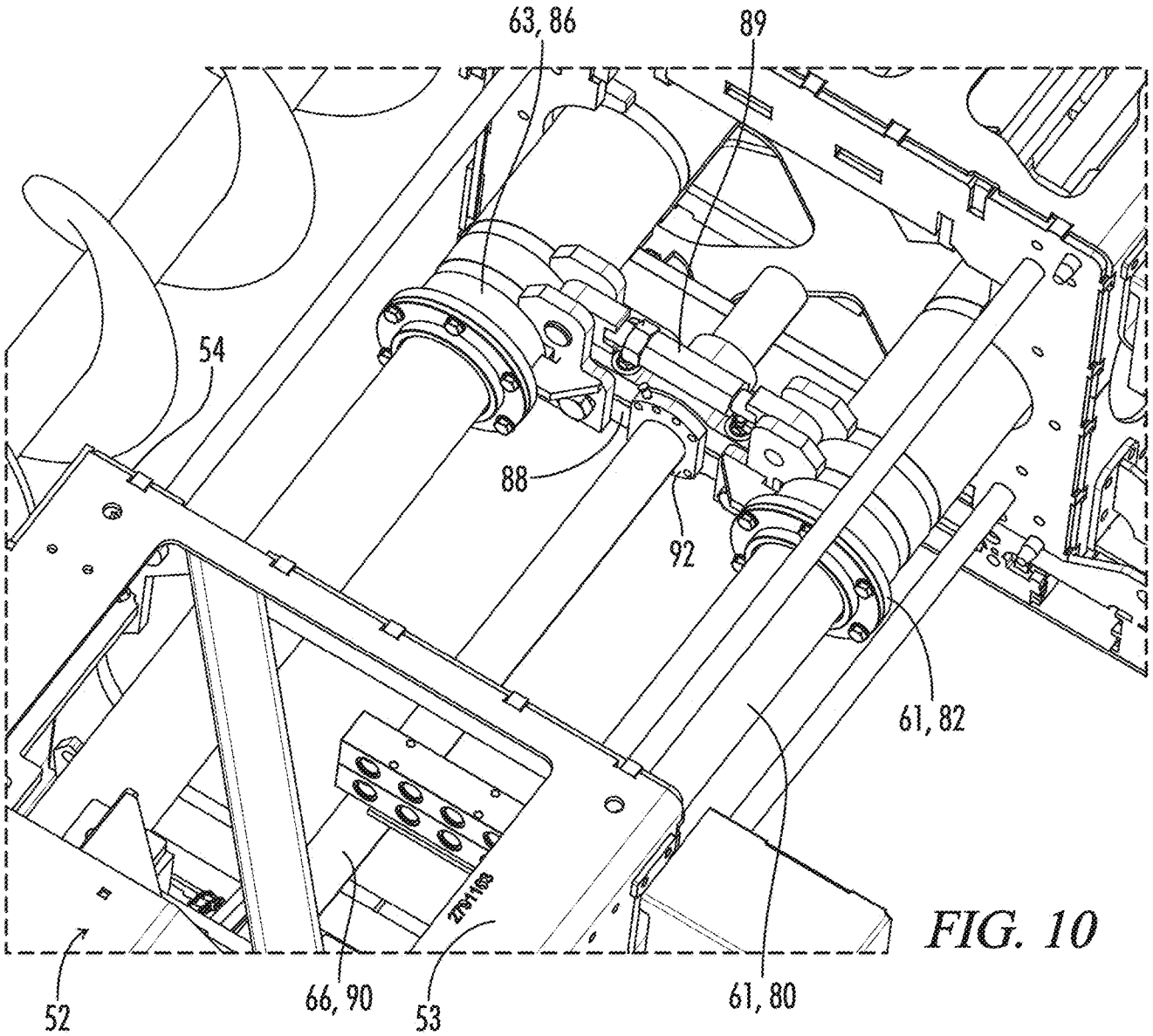
FIG. 10 is a perspective view showing the left rotary spindle actuator engaged with the left nut.

The left actuator 66, which is best seen in FIG. 9 in isolated view, is preferably a rotary spindle type actuator including a rotary spindle 90 which is threadably received in a threaded bore 93 of a left nut 92 as best seen in FIG. 10. It is noted that the external surface of the rotary spindle 90 is threaded, but the threads are not shown in the drawing. The left nut 92 is mounted in the bridge 88 between upper and lower bridge portions 88.1 and 88.2. As is further apparent in FIG. 10, the rotary spindle 90 of the left actuator 66 is connected to the left nut and thus to the bridge 88.

More generally, the left actuator 66 can be described as having a rotary spindle 90 connected to one of the left sideform assembly 52 and the center portion 48, and a nut 92 connected to the other of the left sideform assembly 52 and the center portion 48, with the rotary spindle 90 being received in the nut 92.

The left actuator 66 may be hydraulically actuated via a hydraulic motor 67 which drives a gearbox 69 via a chain and sprocket drive 71. The gearbox 69 may be mounted on the sideform framework 53 via bolts (not shown).

As can be seen for example in FIG. 10 and FIG. 11 A, the one or more left spacers 76 are supported on a plurality of left side hanger rods, including a forward upper hanger rod 100, a forward lower hanger rod 102, a rearward upper hanger rod 104, and a rearward lower hanger rod 106. The left side hanger rods 100-106 extend between the left sideform assembly 52 and the center portion 46. The left side hanger rods 100-106 are completely separate from the left telescoping support assembly 60.

Figure 13:
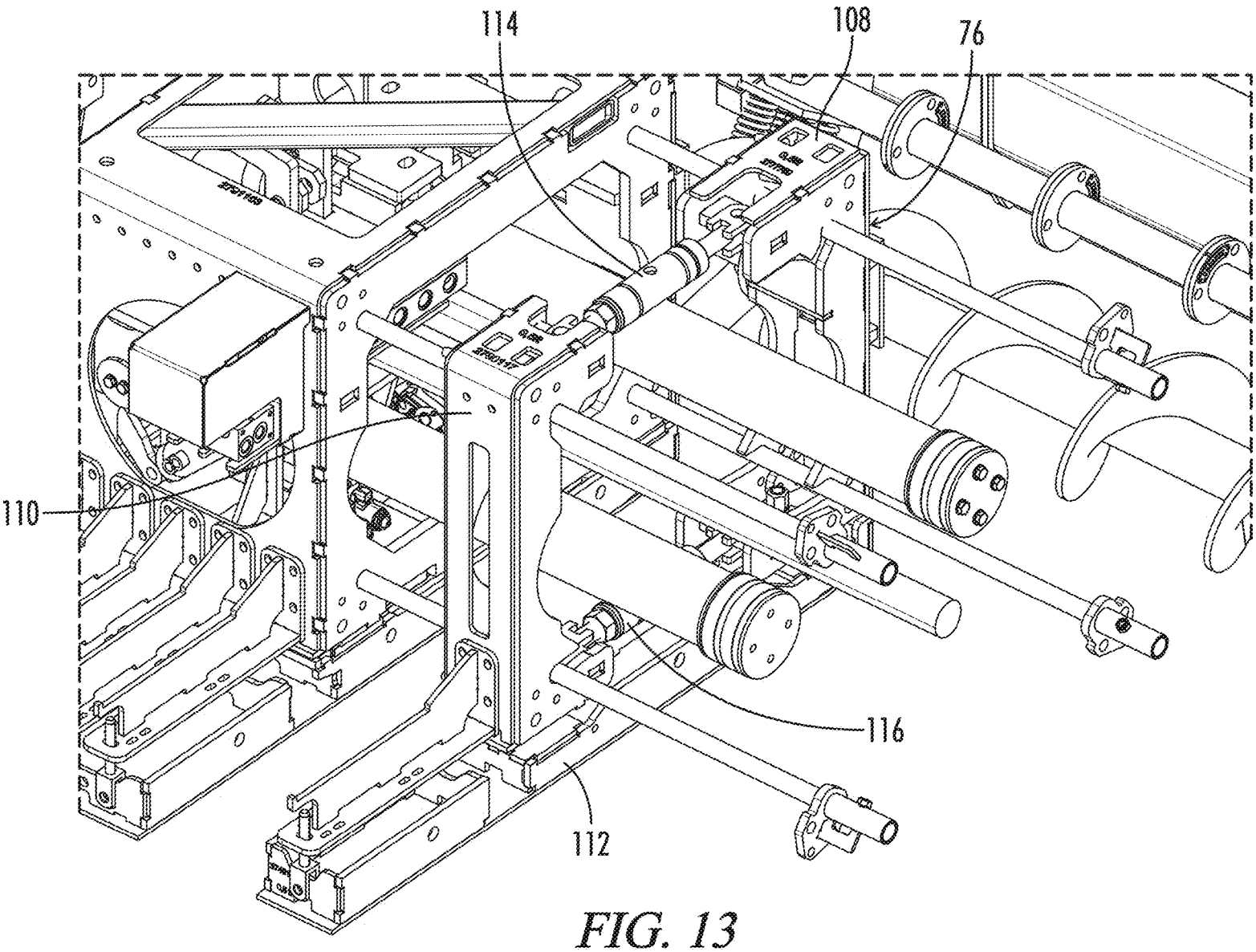
FIG. 13 is a perspective view showing the assembled and installed spacer of FIGS. 11C and 12C.

As is best seen for example in FIG. 13 each of the left side spacers 76 includes a forward spacer portion 108, a rearward spacer portion 110, a pan or wear plate 112, an upper adjustable length connector 114 and a lower adjustable length connector 116. The upper and lower adjustable length connectors 114 and 116 may for example be turnbuckles.

Figure 11A:
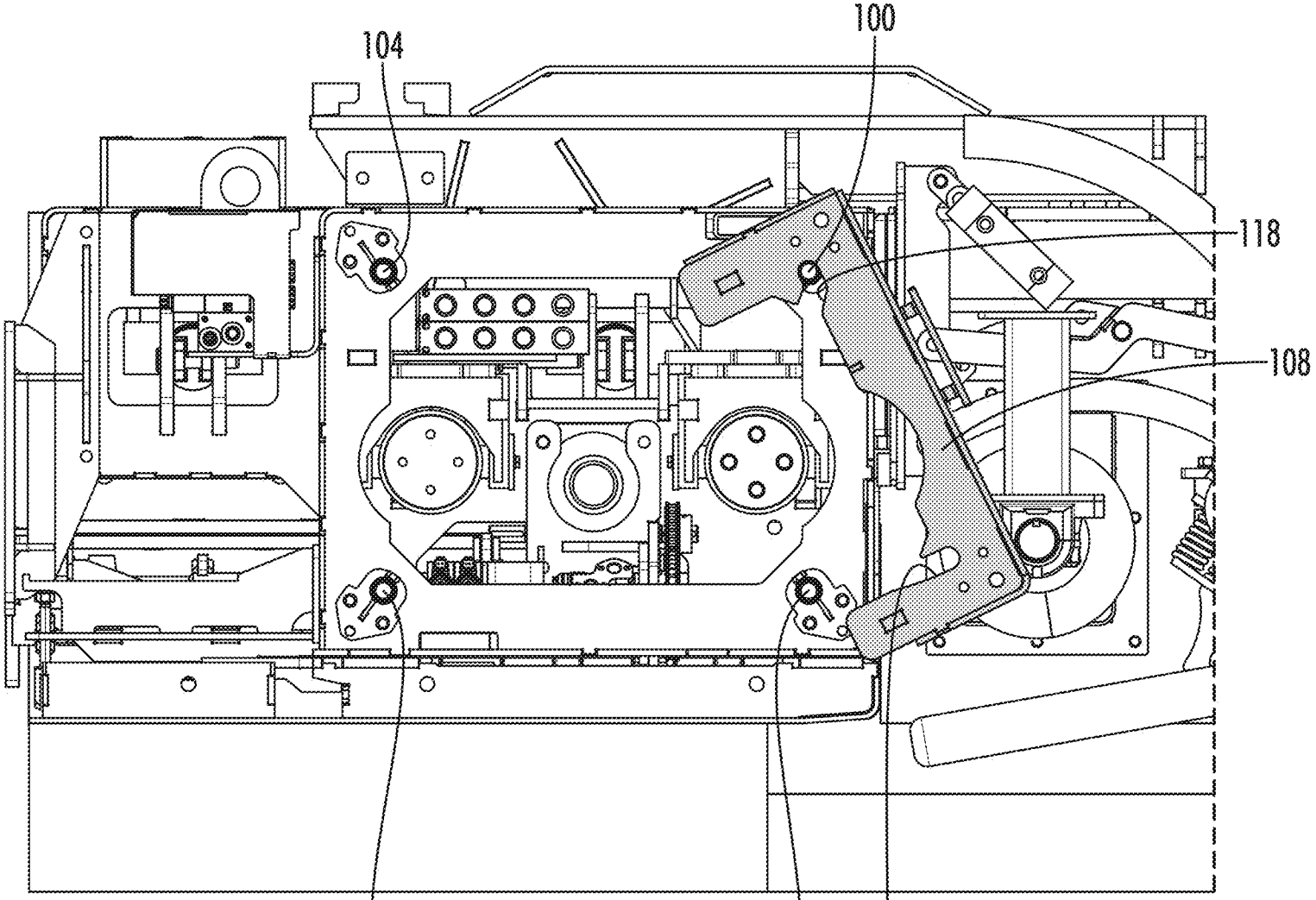
FIGS. 11A, 11B and 11C comprise a sequence of views showing the installation of a forward spacer portion or forward spacer frame.
Figure 11B:
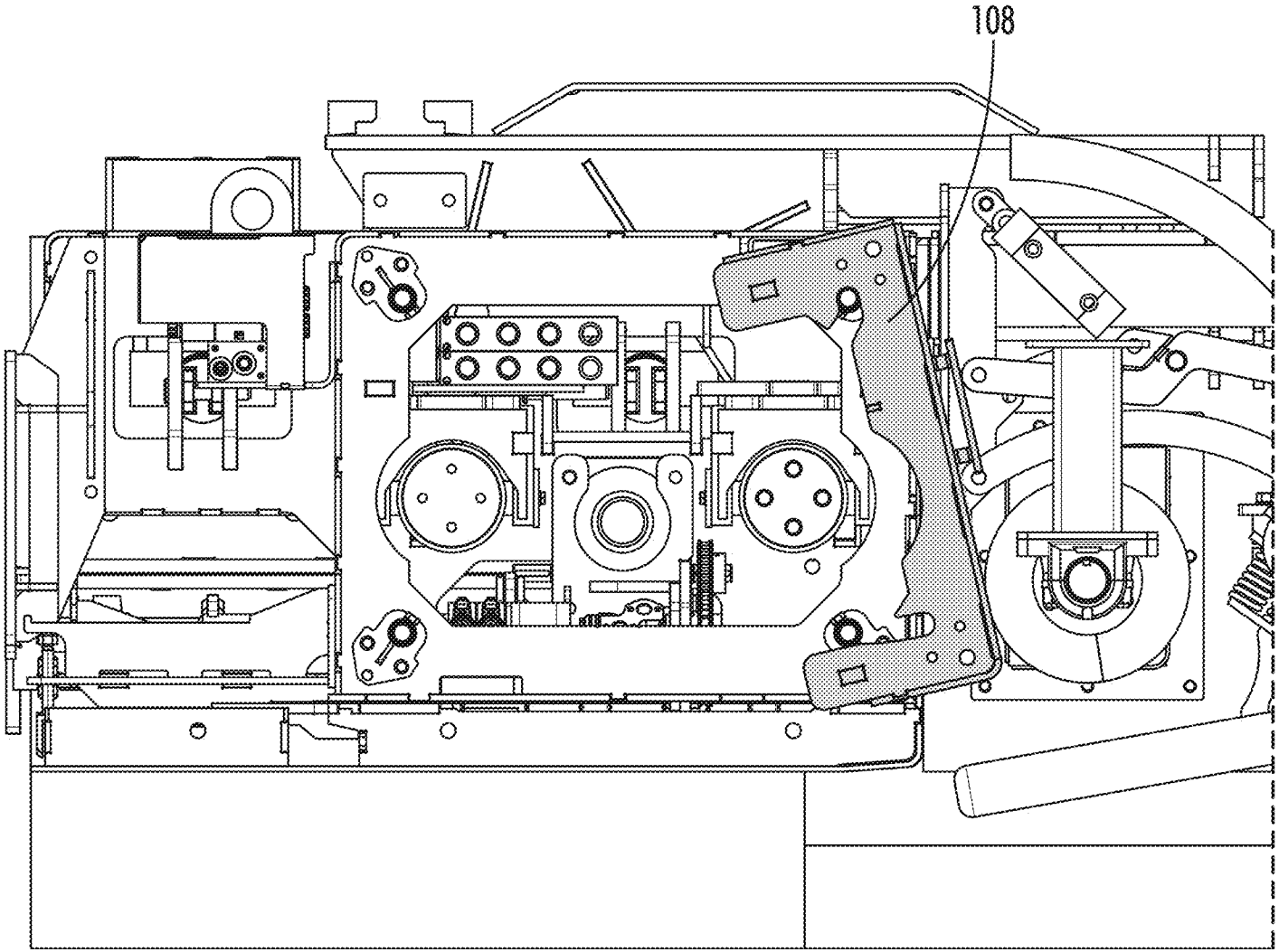
Figure 11C:
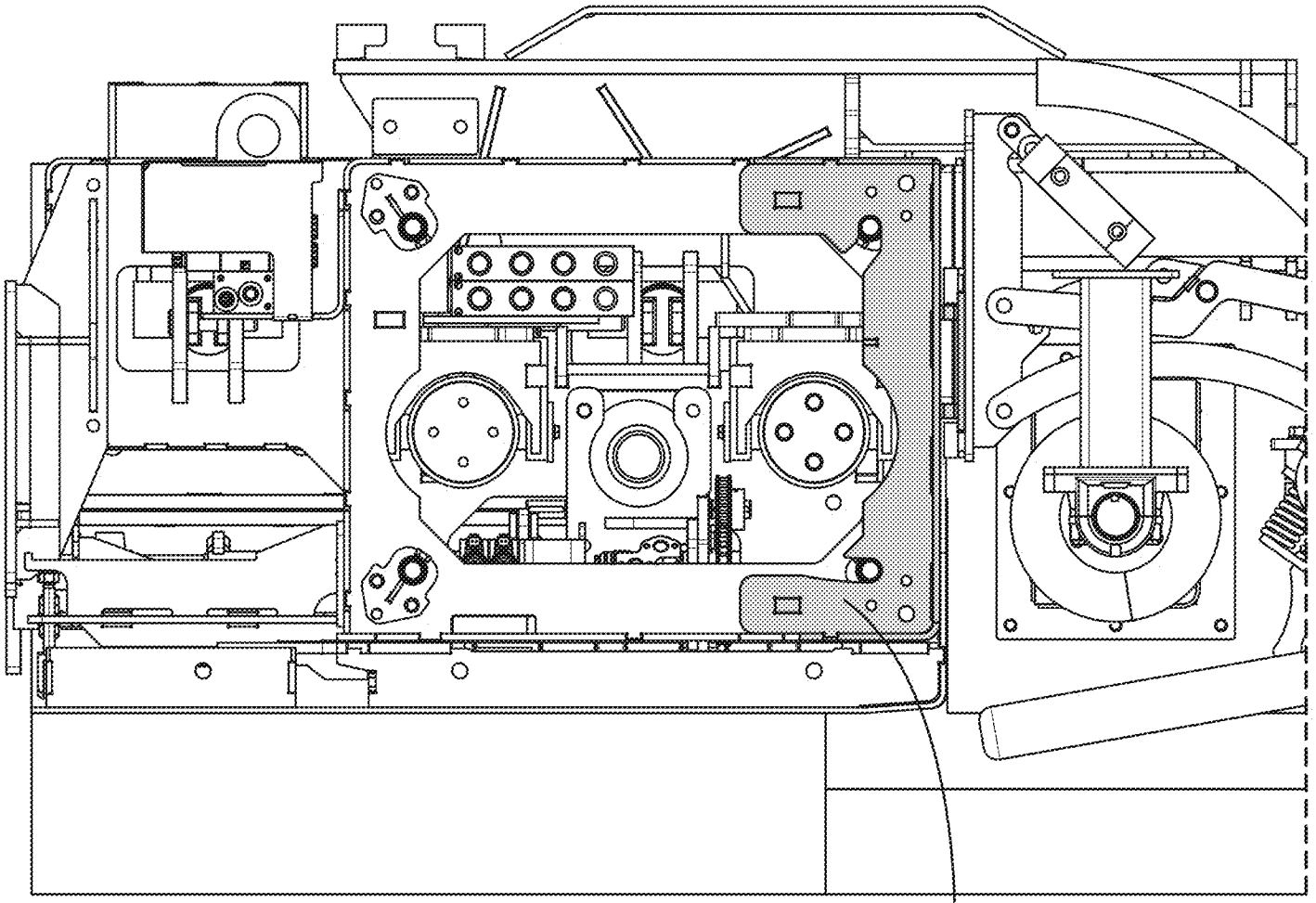

FIGS. 11A-11C show a sequential series of steps of installing the forward spacer portion 108 of one of the left side spacers 76 upon the forward hanger rods 100 and 102. The forward spacer portion 108 includes an upper slot 118 at least a portion of which is substantially vertical. The slot 118 may be described as an at least partially vertical upper slot 118 for hanging the forward spacer portion 108 on the forward upper hanger rod 100 as seen in FIG. 11 A. The forward spacer portion 108 further includes a lower slot 120 at least a portion of which is horizontal for receiving the forward lower hanger rod 102 when the forward spacer portion 108 is swung into a substantially vertical orientation as seen in FIG. 11C after being hung on the forward upper hanger rod 100. The sequential series of FIGS. 11A-11C first shows the forward spacer portion 108 with its lower end tilted forward and with the upper slot 118 being fitted over the forward upper hanger rod 100. Then the forward spacer portion 108 is pivoted clockwise about the forward upper hanger rod 100 through the position of FIG. 11B to the final position of FIG. 11C wherein the forward lower hanger rod 102 is received in the horizontal portion of the lower slot 120.

Figure 12A:
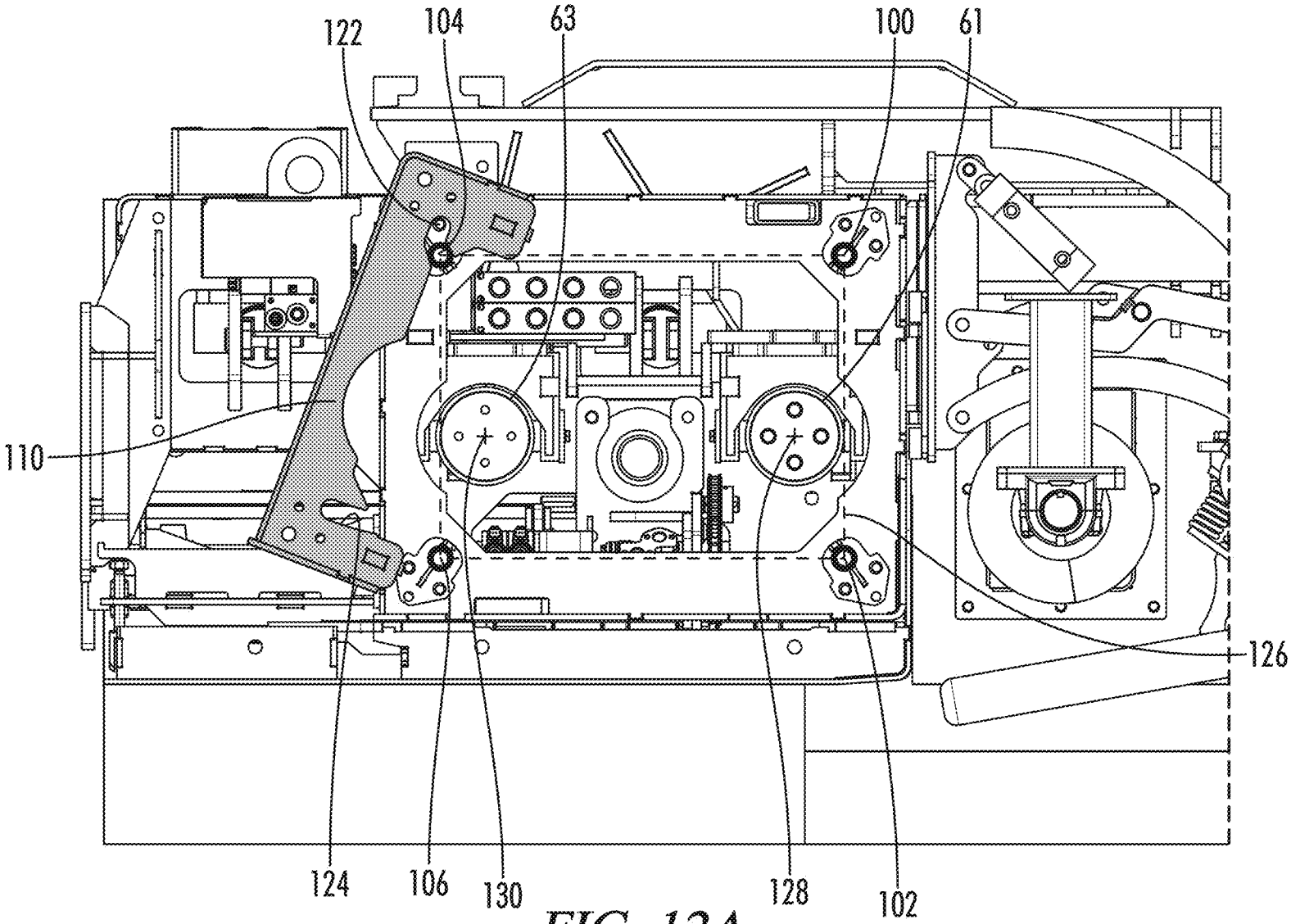
FIGS. 12A, 12B and 12C comprise a sequence of views showing the installation of a rearward spacer portion or rearward spacer frame.
Figure 12B:
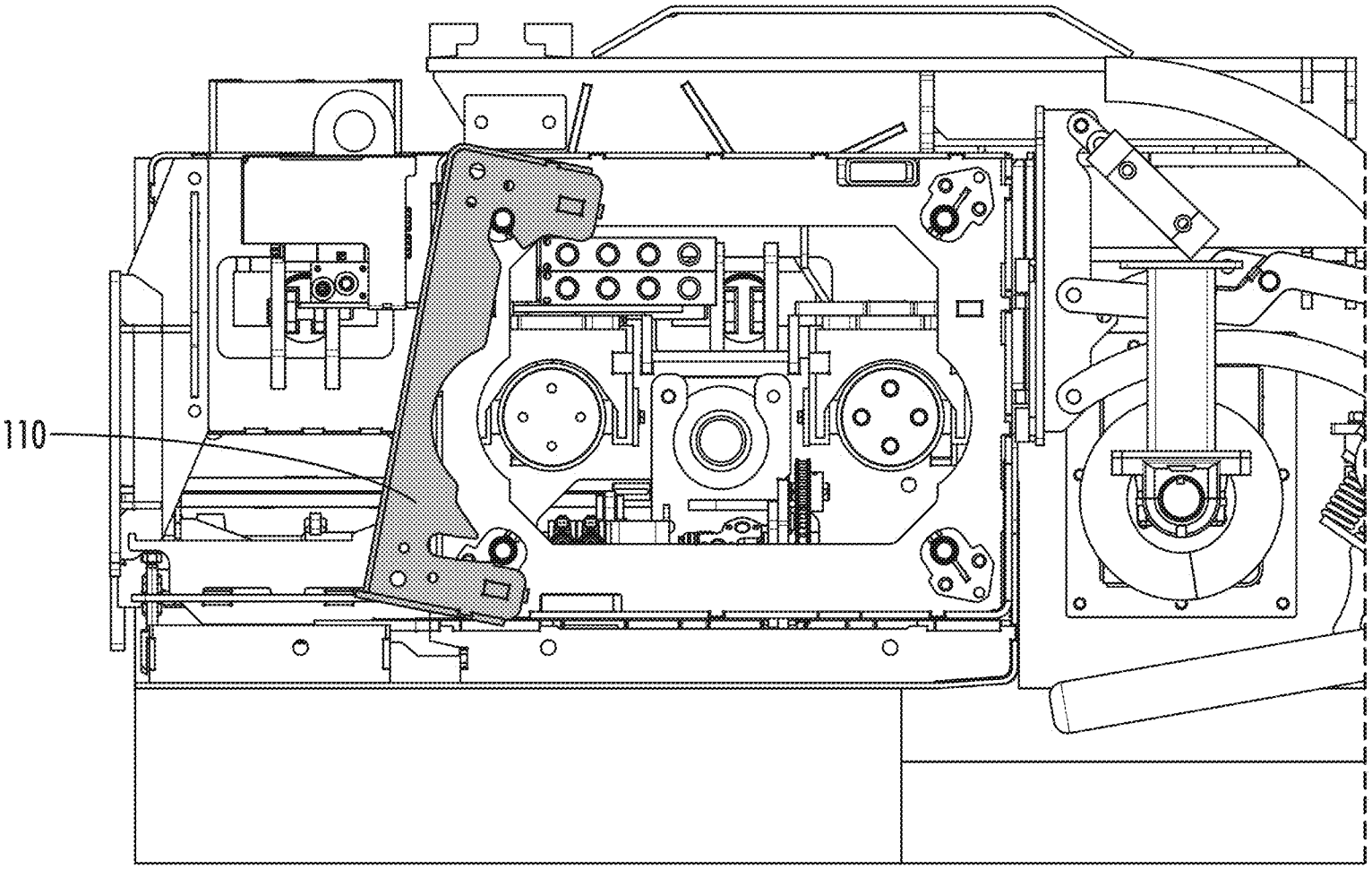
Figure 12C:
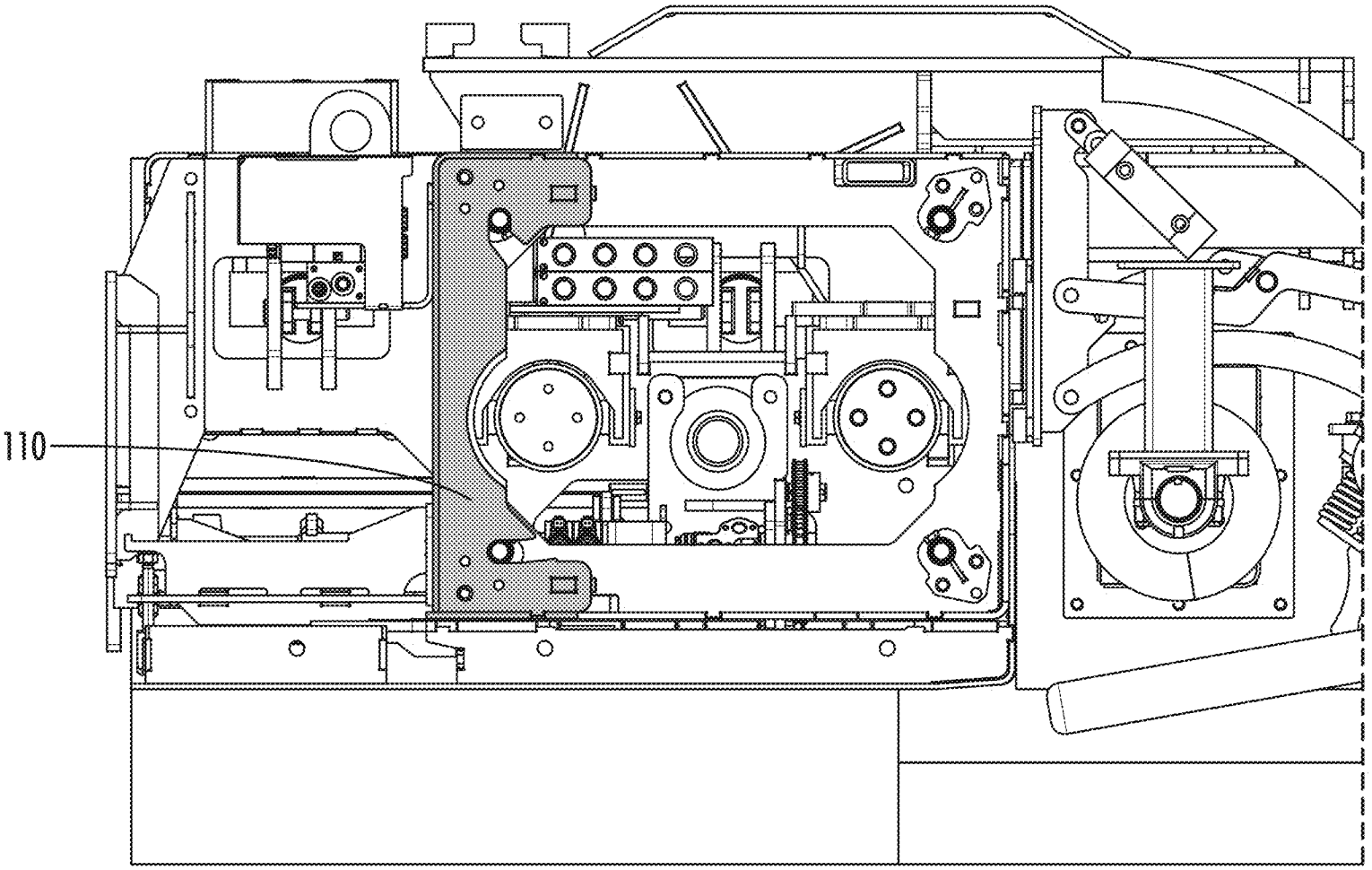

Similarly as shown in FIGS. 12A-12C the rearward spacer portion 110 includes an at least partially vertical upper slot 122 for hanging the rearward spacer portion 110 on the rearward upper hanger rod 104, and an at least partially horizontal lower slot 124 for receiving the rearward lower hanger rod 106 when the rearward spacer portion 110 is swung in a counterclockwise direction through the position of FIG. 12B to the substantially vertical orientation of FIG. 12C. After the forward and rearward spacer portions 108 and 110 are hung as shown in FIGS. 11C and 12C, the pan 112 is connected to the lower ends of the forward and rearward spacer portions 108 and 110, and the upper and lower adjustable length connectors 114 and 116 are connected between the forward and rearward spacer portions 108 and 110 to form the assembly shown in FIG. 13 wherein the spacer 76 is held upon the four hanger rods. When the left telescoping assembly 60 is retracted the one or more spacers 76 can slide upon the hanger rods so that the spacers 76 are firmly clamped between the left sideform assembly 52 and the center portion 46.

Figure 14:
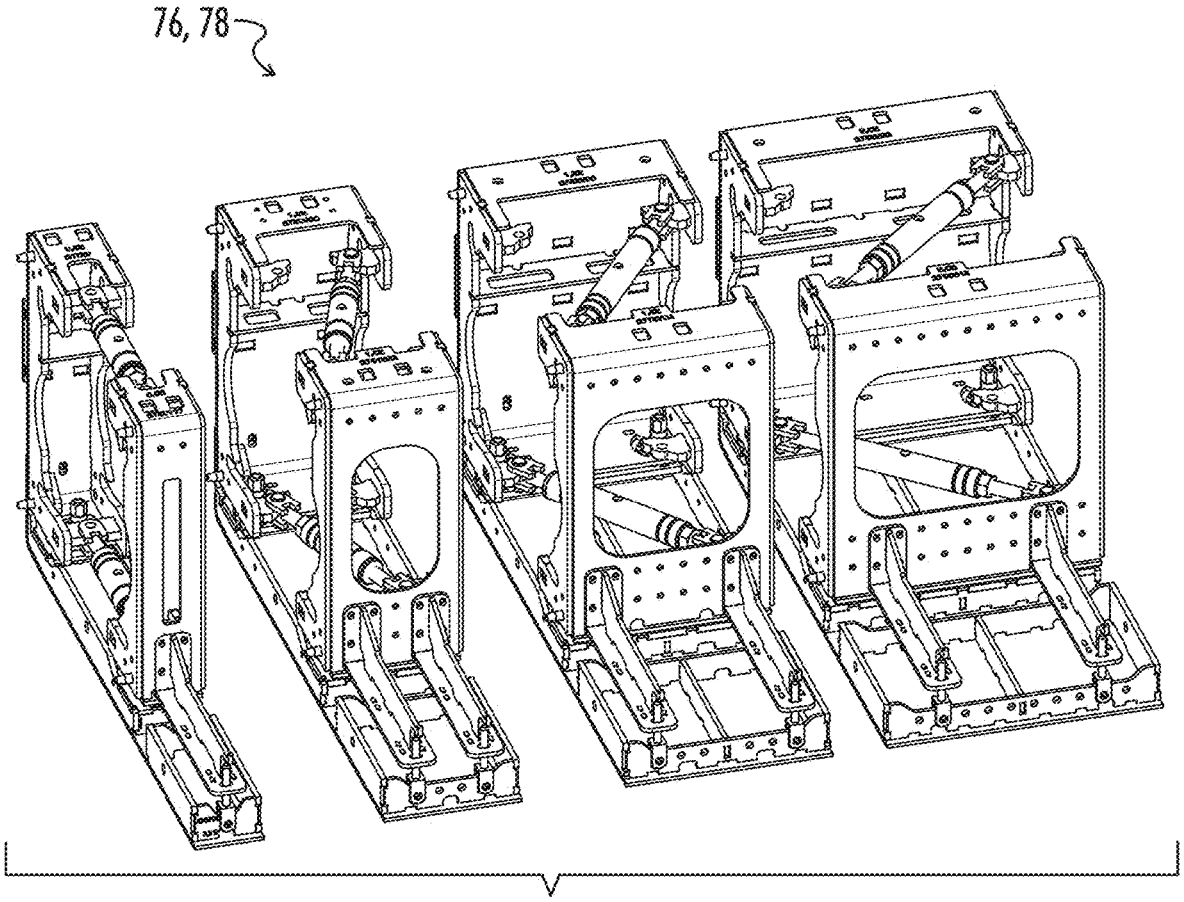
FIG. 14 is a perspective view of a side by side arrangement of four different sizes of spacers.

FIG. 14 illustrates in side by side fashion four different sizes of spacers 76, 78. From left to right the illustrated spacers have lateral widths of 0.5 ft, 1.0 ft, 1.5 ft and 2.0 ft, respectively. Each of the telescoping assemblies 60 and 68 may be configured to extend such as to provide a maximum space between the sideform assemblies and the center portion of about 3.0 ft so that one or more of the spacers 76, 78 may be required to fill the space.

As can be seen for example in FIG. 12A in lateral end view the plurality of left side hanger rods 100, 102, 104 and 106 define corners of an imaginary rectangular border 126. Center axes 128 and 130 of the forward and rearward left telescoping tube assemblies 61 and 63 all lie within the imaginary border 126.

Preferably each of the left side hanger rods 100-106 is fixedly attached to the left sideform assembly 52 and is slidably received through one or more openings in the left lateral end 48 of the center portion 46. Similarly, each of the right side hanger rods is fixedly attached to the right sideform assembly 56 and is slidably received through one or more openings in the right lateral and 50 of the center portion 46. Thus when the left sideform assembly 52 is retracted by the left telescoping assembly 60 toward the center portion 46, the left side hanger rods 100-106 may slide into the center portion 46. Similarly, when the right sideform assembly 56 is retracted by the right telescoping assembly 68, the right side hanger rods may slide into the center portion 46.

Embodiment of FIGS. 15-34

Figure 15:
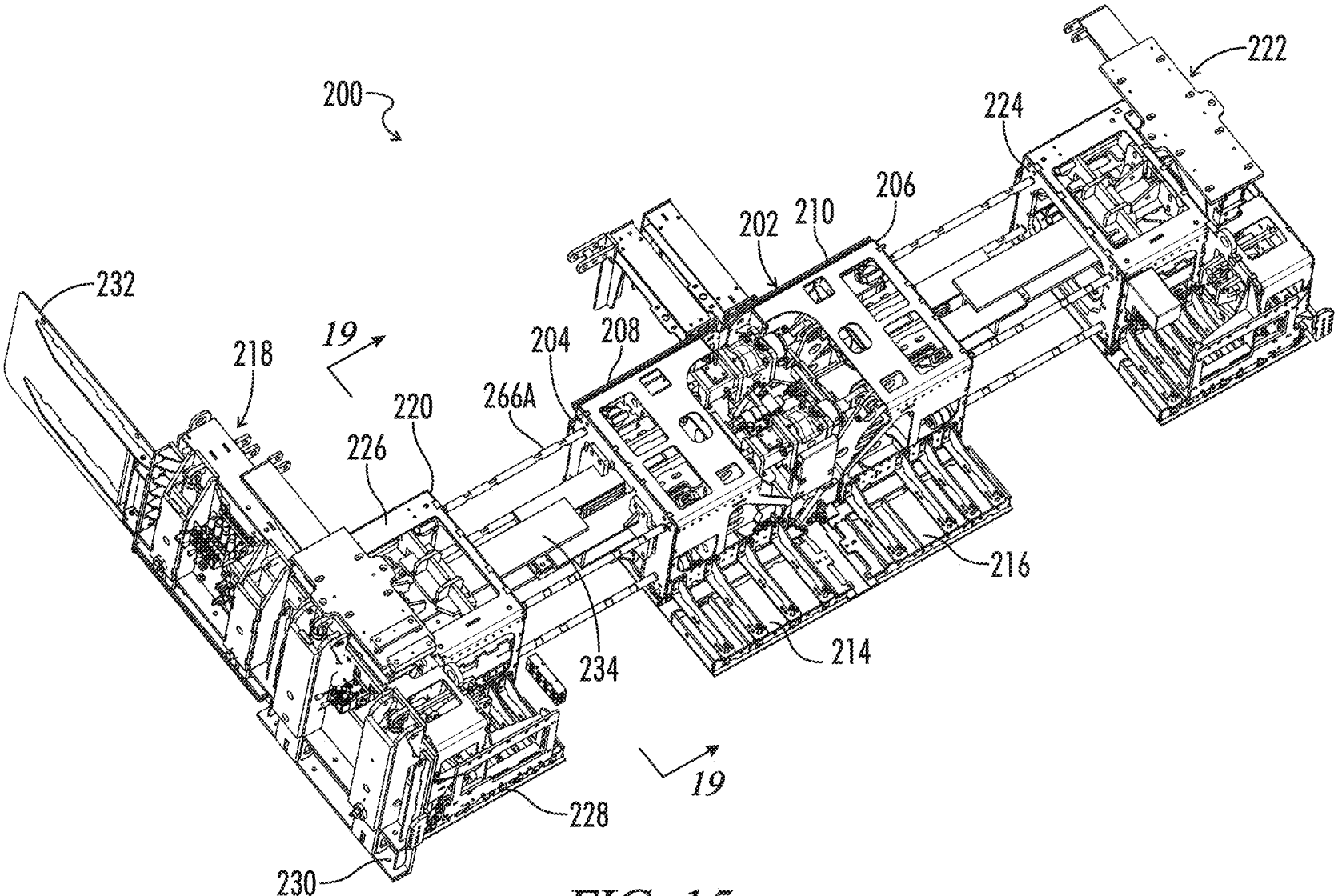
FIG. 15 is a rear left side perspective view of another embodiment of the adjustable width mold apparatus, using an I-beam type of adjustable width support, with each of the sideform assemblies in an extended position providing a space to receive one or more spacers.

FIG. 15 is a rear left side perspective view of another embodiment of the adjustable width mold apparatus generally designated by the number 200.

Figure 16:
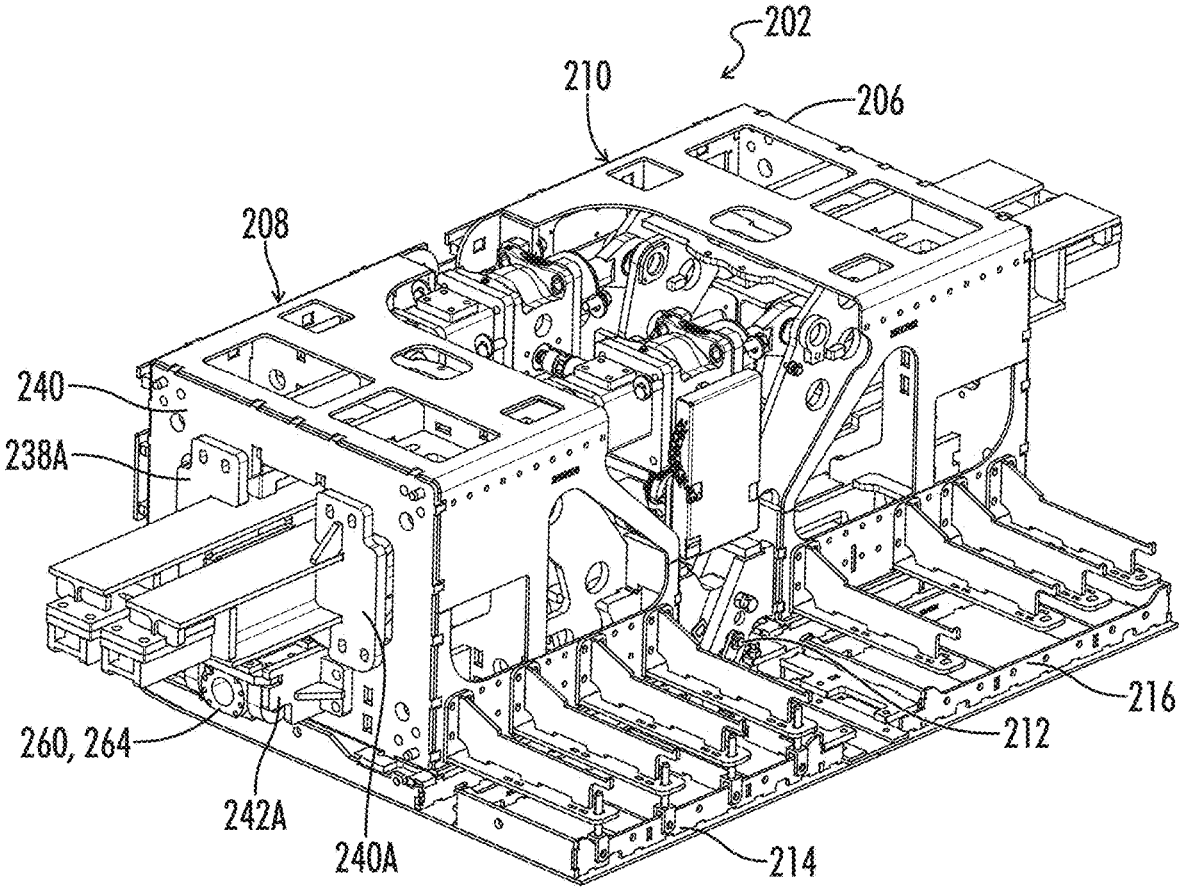
FIG. 16 is an enlarged view of the center portion of the adjustable width mold apparatus of FIG. 15.

Referring now to FIGS. 15 and 16 the adjustable width mold apparatus 200 includes a center portion 202 terminating in left and right lateral ends 204 and 206. The center portion 202 may be of the type configured to allow the formation of a crown in the molded concrete structure 16. In such an embodiment, the center portion 202 includes a left center portion half 208 and a right center portion half 210 joined together by a pivoted connection 212 such that the left and right center portion halves 208 and 210 can be pivoted relative to each other to form a crown in the molded structure 16. Left and right center portion pan portions 214 and 216 are attached to the bottom of the left and right center portion halves 208 and 210 and define the center portion of the generally horizontal mold surface for forming the top surface 18 of the molded concrete structure 16.

The adjustable width mold apparatus 200 further includes a left sideform assembly 218 having a laterally inner end 220 and a right sideform assembly 222 having a laterally inner end 224.

The left sideform assembly 218 may include a sideform framework 226 on which the laterally inner end 220 is defined. A left sideform assembly pan portion 228 is attached to the bottom of the sideform framework 226 and defines the leftmost portion of the generally horizontal mold surface for forming the top surface 18 of the molded concrete structure 16. The left sideform assembly 218 may further include a left sideform 230 which extends vertically downward from the sideform framework 226 to seal the left end of the mold and thus to form the left wall 20 of the molded structure 16. A guide panel 232 may extend forward from the sideform 230 to guide the unformed concrete mixture into the mold. The right sideform assembly 222 is similarly constructed.

Figure 18:
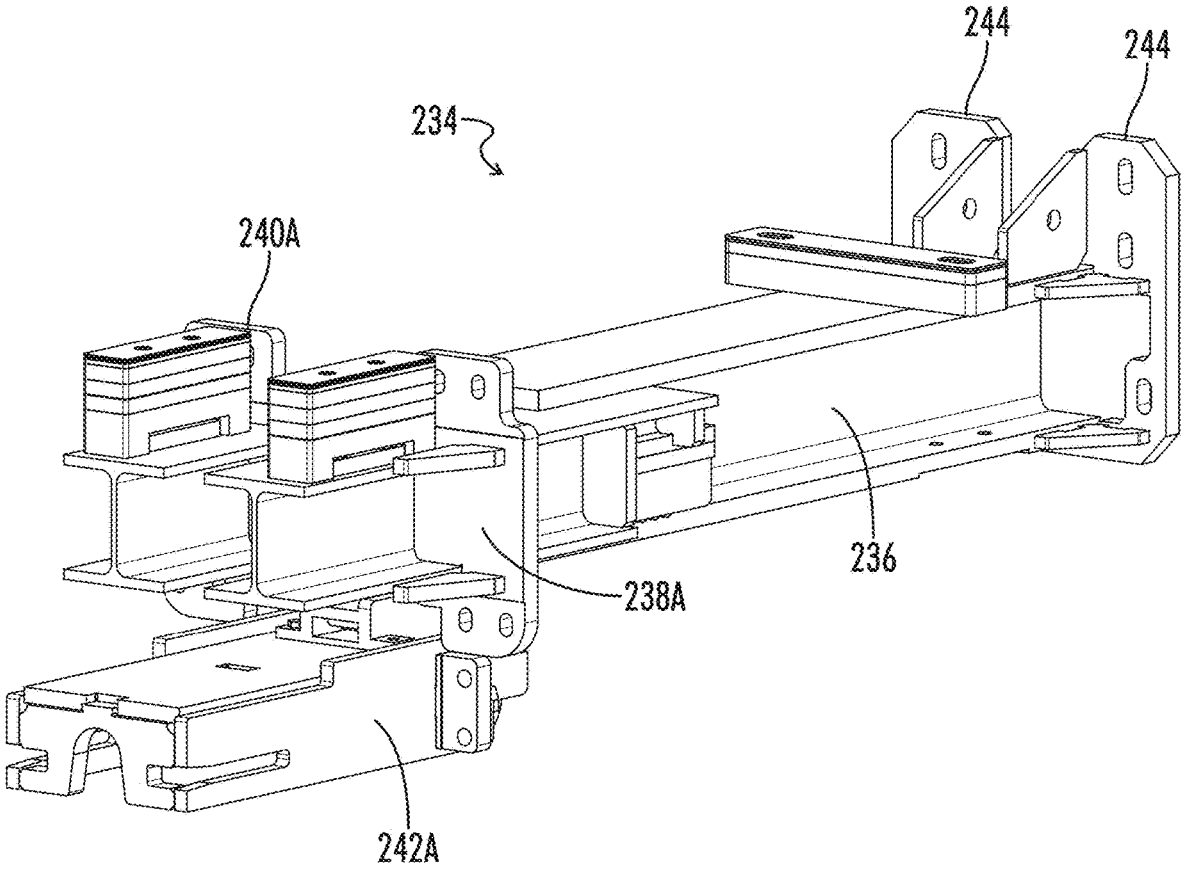
FIG. 18 is a perspective view of the I-beam and the three roller guide mounting bases taken from the front center and looking toward the left sideform. The left side of FIG. 18 shows the three roller guide mounting bases, and the right side shows the laterally outer end of the I-beam with its mounting flanges for mounting on the left sideform assembly.

A left adjustable width support assembly 234 is connected between the left sideform assembly 218 and the center portion 202. FIG. 18 shows the left adjustable width support assembly 234 in isolation in perspective view.

The left adjustable width support assembly 234 may include an I-beam 236 connected to one of the left sideform assembly 218 and the center portion 202, and a plurality of roller guides 238, 240, 242 connected to the other of the left sideform assembly 218 and the center portion 202. The I-beam 236 is slidingly received between the roller guides 238, 240 and 242.

In the embodiment illustrated the I-beam 236 is fixedly connected to the left sideform assembly 218 by an end flange 244 which is bolted to the sideform framework 226. The roller guides 238, 240 and 242 are connected to the left end 204 of the center portion 202 by separate roller guide mounting bases 238A, 240A and 242A which have flanges bolted to the left lateral end 204 of the center portion 202. In an alternative embodiment (not shown) the roller guides 238, 240 and 242 could all be attached to one common roller guide mounting base.

Figure 20A:
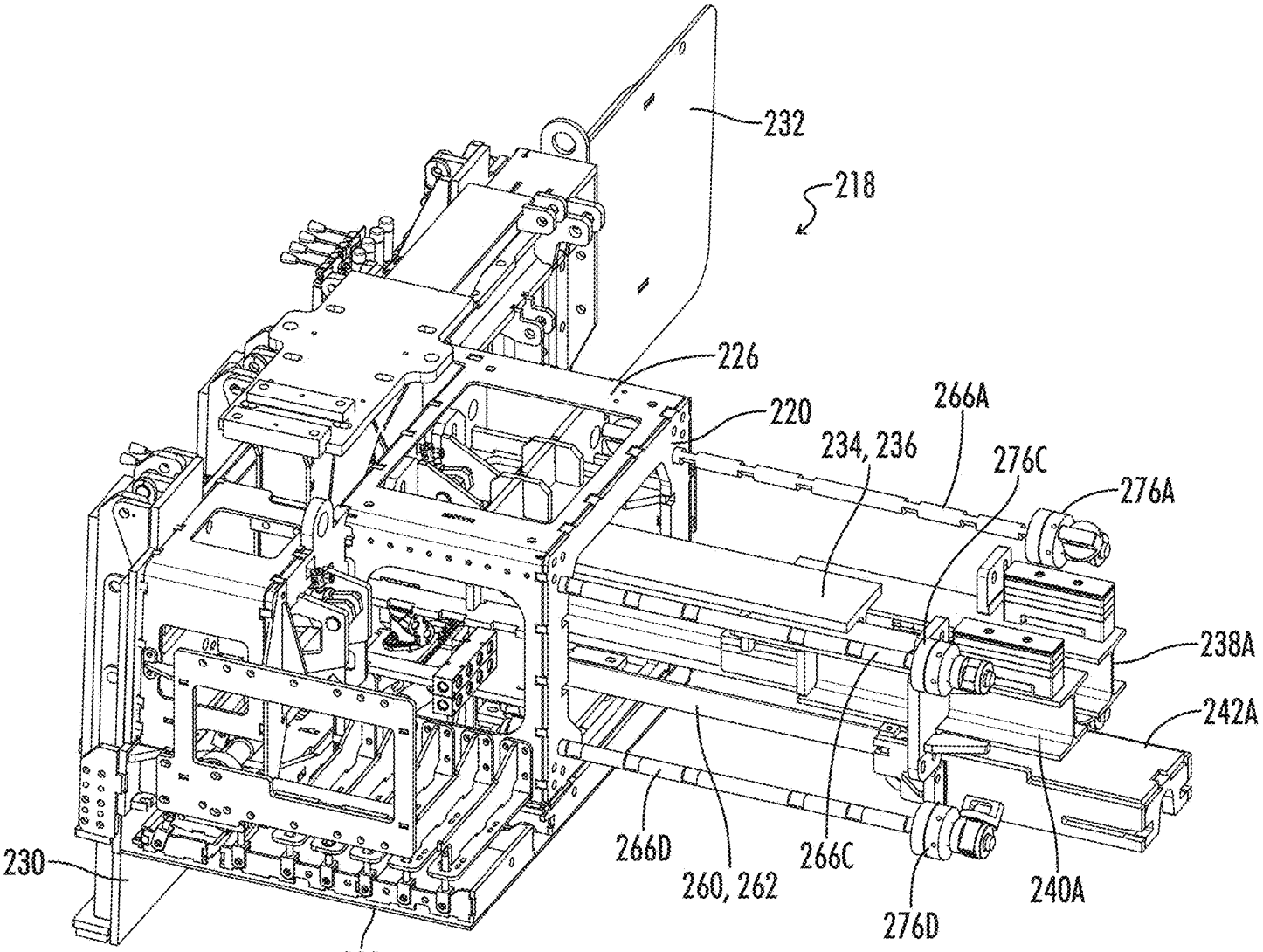
FIG. 20A is a perspective view of the left sideform assembly with the left adjustable width assembly and the four hanger rods extending therefrom. The center portion has been removed so that the three roller guide mounting bases and the four hydraulic nuts can be better seen.
Figure 20B:
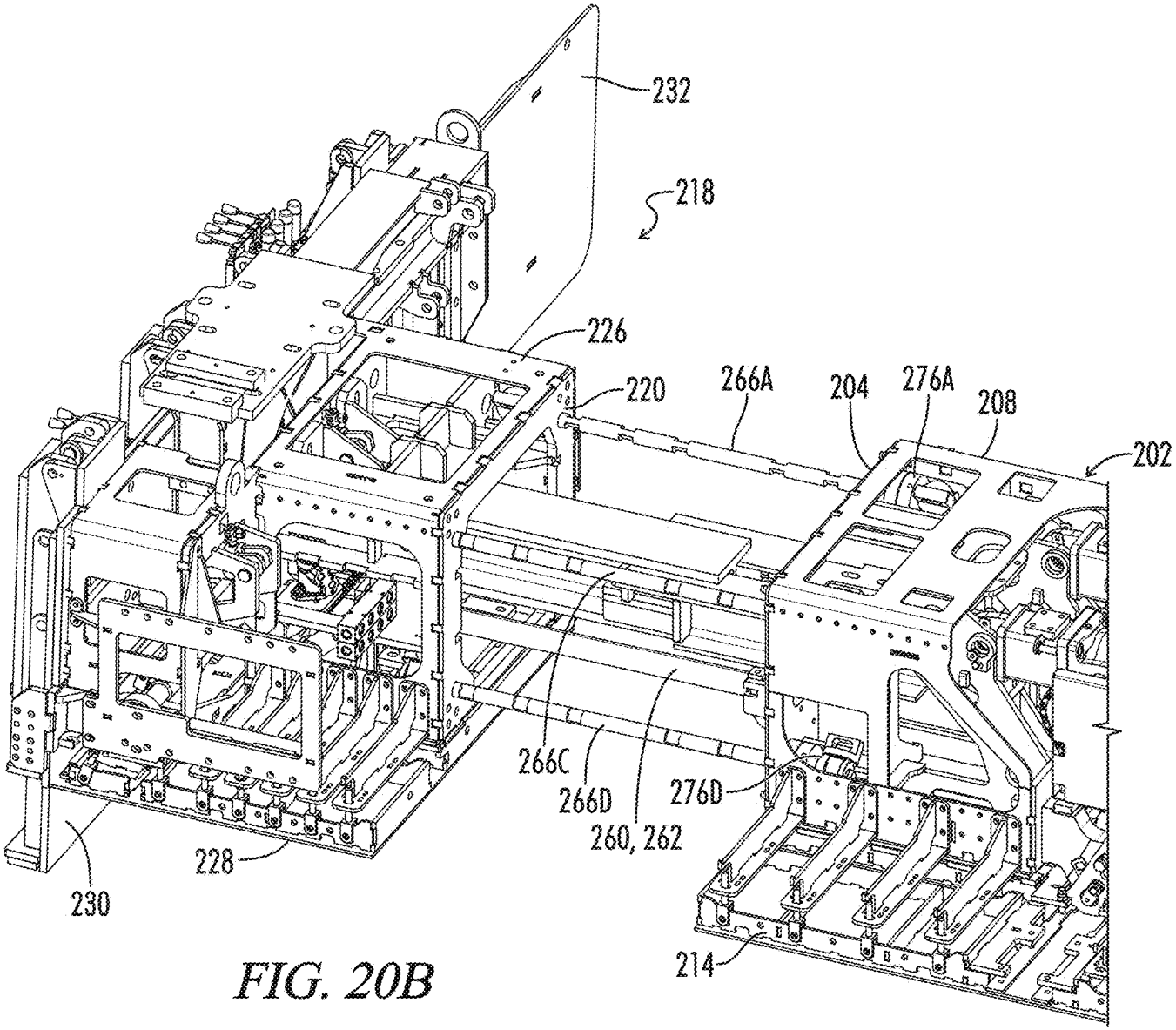
FIG. 20B is view like FIG. 20A but with the center portion shown.

As can be seen by comparing FIGS. 20A and 20B each of the roller guide mounting bases 238A, 240A and 242A extends laterally inward of the left lateral end 204 of the center portion 202.

Figure 19:
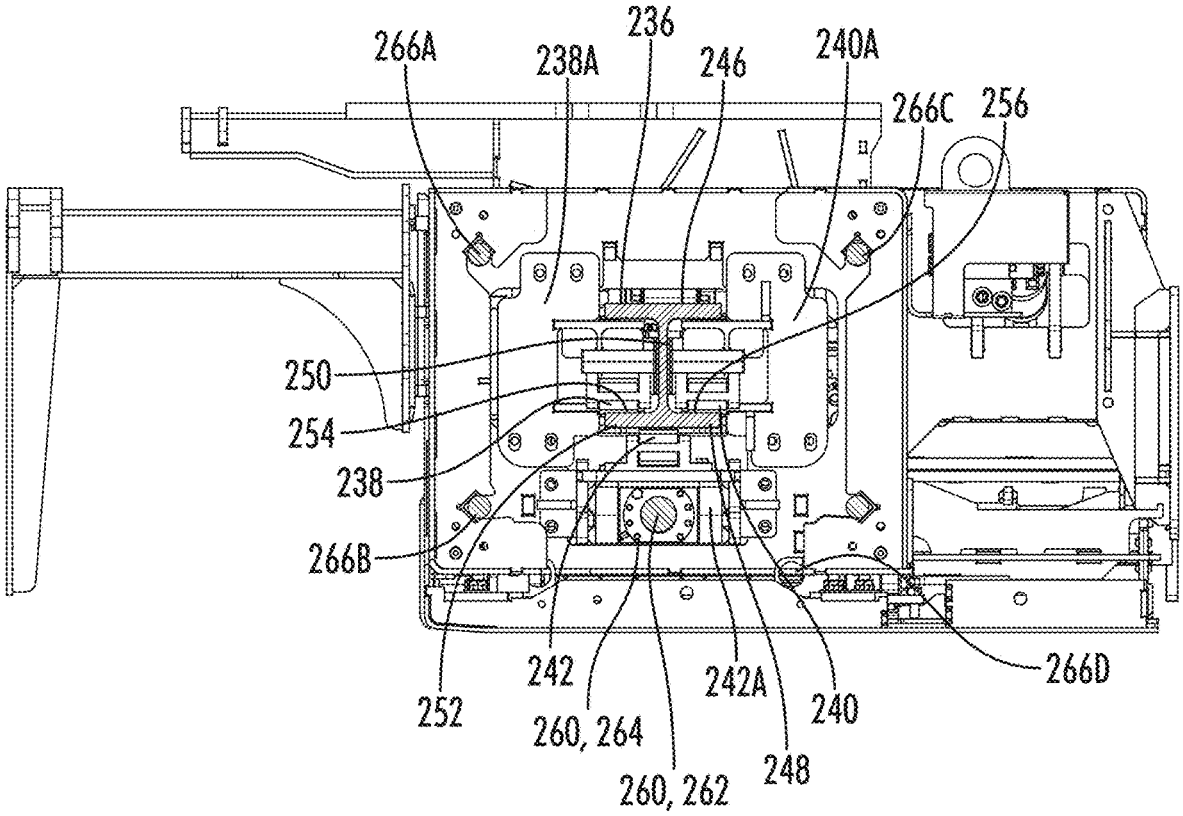
FIG. 19 is a cross-sectional view taken along line 19-19 of FIG. 15. Also front and rear spacer parts are shown hanging on the hanger rods.

As best seen in the cross-sectional end view of FIG. 19, the I-beam 236 includes a top flange 246, a bottom flange 248, and a vertical central web 250 joining the top flange 246 and the bottom flange 248. The roller guide 242 can be described as an outer roller guide 242 engaging an outer surface 252 of the bottom flange 248. The roller guides 238 and 240 can be described as first and second inner roller guides 238 and 240 engaging inner surfaces 254 and 256 of the bottom flange 238. The first and second inner roller guides 238 and 240 can be described as being on opposite sides of the vertical central web 250. It will be appreciated that instead of having the roller guides associated with the bottom flange 238 the roller guides could be associated with the top flange 236.

Each of the adjustable width support assemblies such as 234 has associated therewith an actuator such as 260 for extending and retracting the adjustable width support assembly. The left actuator 260 is constructed like the actuator 66 seen in FIG. 9 in isolated view, and is preferably a rotary spindle type actuator including a rotary spindle 262 which is threadably received in a threaded bore of a spindle nut 264 as seen for example in FIG. 19. The spindle nut 264 is fixedly mounted in the lower roller guide mounting base 242A, and this is attached to the center portion 202. The details of the actuator 260 are as described above regarding FIG. 9 and will not be repeated.

Figure 17:
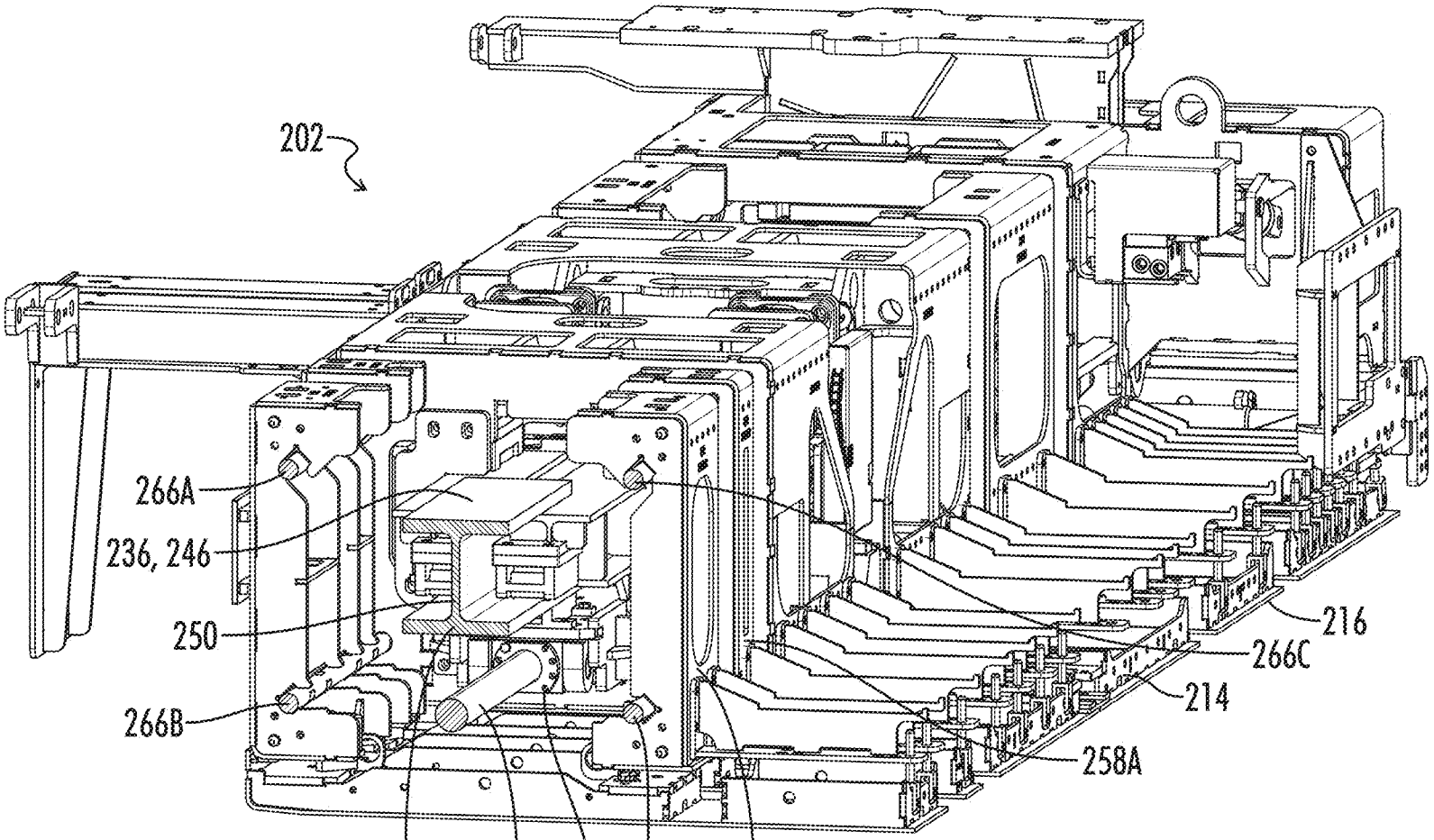
FIG. 17 is a further view similar to FIG. 16, but showing portions of two spacers in place, and also showing the I-beam and the hydraulic spindle extending from the center portion.

As seen in FIG. 17 one or more left spacers 258A, 258B, etc., are configured to be received between the laterally inner end 220 of the left sideform assembly 218 and the left lateral end 204 of the center portion 202, such that upon retraction of the left sideform assembly 218 as further described below a laterally innermost one of the one or more left spacers 258A is held directly against the left lateral end 204 of the center portion 202. Similarly, upon retraction of the left sideform assembly 218 a laterally outermost one of the one or more left spacers 258B is held directly against the laterally inner end 220 of the left sideform assembly 218. Also, the left adjustable width support assembly 234 is configured such that when no spacers are present and the left actuator 260 is retracted such that the left sideform assembly 218 is pulled into engagement with the left lateral end 204 of the center portion 202, the I-beam 236 extends through the left lateral end 204 of the center portion 202 into the center portion 202. The spacers 258A, 258B are constructed and installed similarly to the spacers described above with reference to FIGS. 11A-14, which description will not be repeated here.

As can be seen for example in FIGS. 15 and 17, the one or more left spacers 258A, 258B are supported on a plurality of left side hanger rods, including a forward upper hanger rod 266A, a forward lower hanger rod 266B, a rearward upper hanger rod 266C, and a rearward lower hanger rod 266D. The left side hanger rods 266A-266D extend between the left sideform assembly 218 and the center portion 202. The left side hanger rods 266A-266D are completely separate from the left adjustable width support assembly 234.

With regard to the support of the spacers 258A, 258B, the hanger rods 266A-266D function similar to the hanger rods 100-106 of the embodiment of FIGS. 1-14 above. But the hanger rods 266A-266D are substantially modified as compared to the hanger rods 100-106 so that the hanger rods 266A-266D also function as tensioning rods as further described below with reference to FIGS. 21-30.

Figure 21:
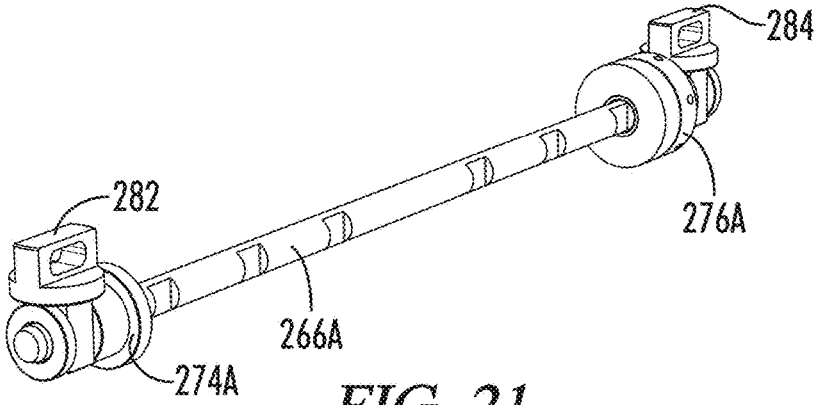
FIG. 21 is a left rear perspective view of one of the left side hanger rods.
Figure 22:
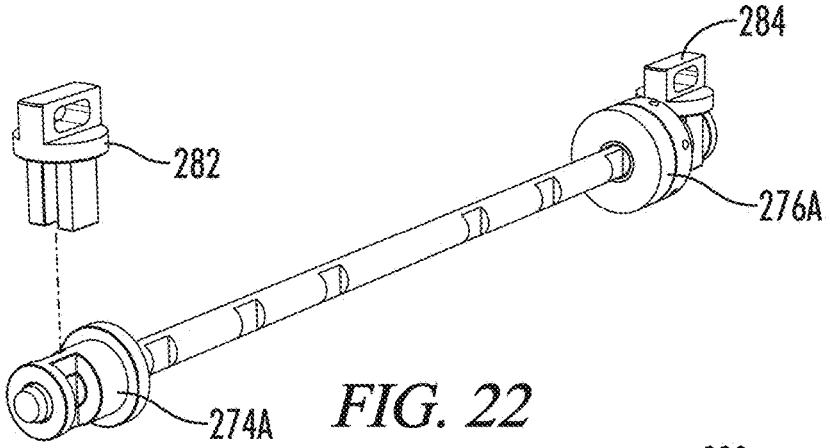
FIG. 22 is similar to FIG. 21 showing the left key in exploded relation to the rest of the left side hanger rod.
Figure 23:
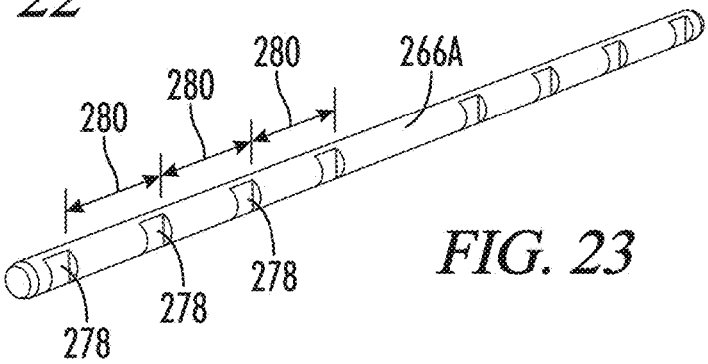
FIG. 23 is a perspective view of one of the hanger rods with the rod anchor and the hydraulic nut removed so the details of the hanger rod can be better seen.
Figure 24:
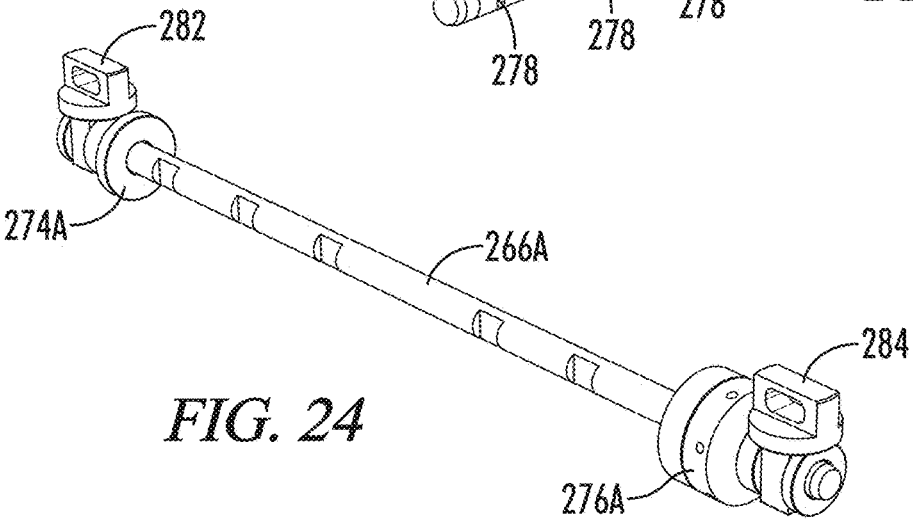
FIG. 24 is another perspective view of the hanger rod of FIG. 21.
Figure 25:
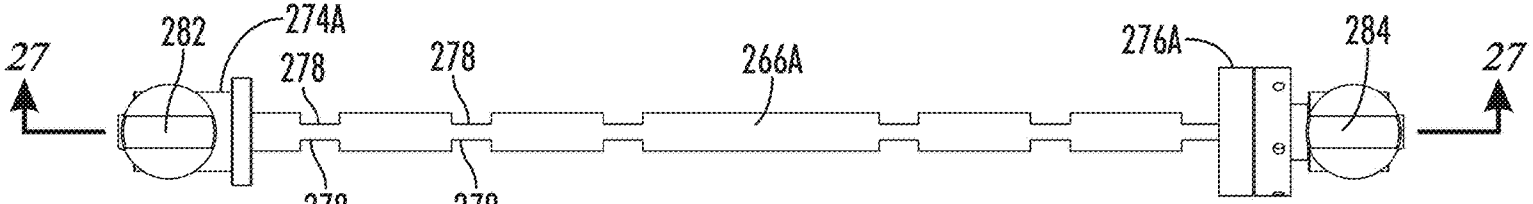
FIG. 25 is a top plan view of the hanger rod of FIG. 21.
Figure 26:
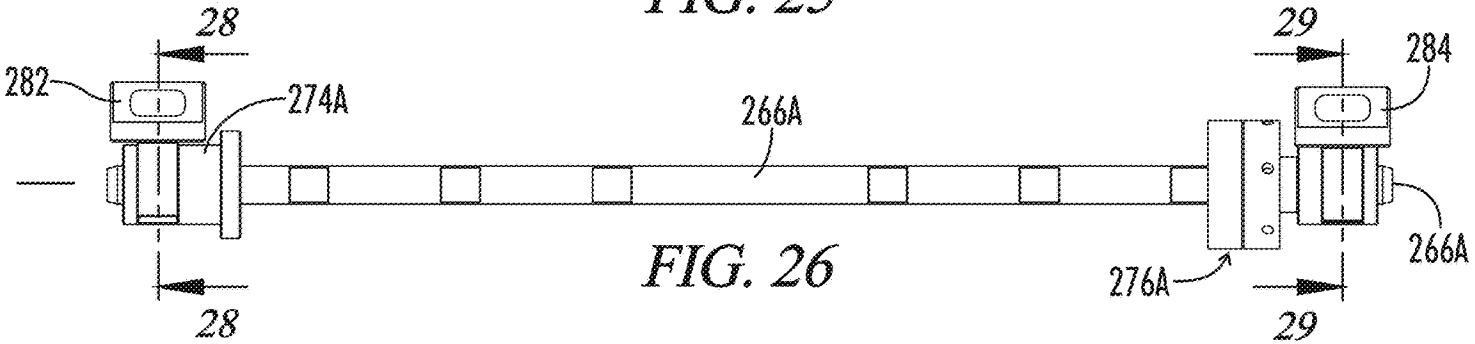
FIG. 26 is a rear elevation view of the hanger rod of FIGS. 21 and 25.
Figure 27:
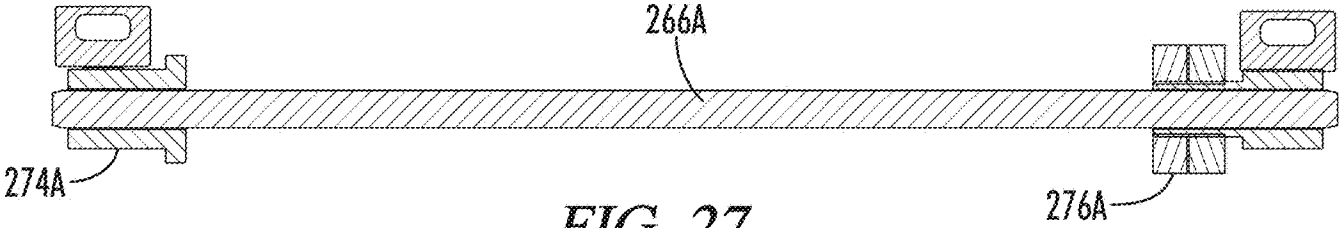
FIG. 27 is a rear elevation section view taken along line 27-27 of FIG. 25.

FIG. 21 is a perspective view of one of the hanger/tensioning rods 266A. Attached to the hanger rod 266A are a rod anchor 274A and a hydraulic nut 276A. As best seen in FIG. 23 the rod 266A includes a plurality of anchoring structures 278 equally spaced at a spacing interval 280 along a length of the rod 266A. As better seen in FIG. 25 each of the anchoring structures 278 includes a pair of diametrically opposed notches formed in the respective rod 266A.

Figure 29:
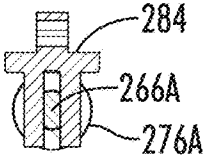
FIG. 29 is a section view through the right side key taken along line 29-29 of FIG. 26.
Figure 28:
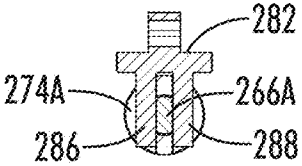
FIG. 28 is a section view through the left side key taken along line 28-28 of FIG. 26.

The rod anchor 274A may be anchored to a selected one of the anchoring structures 278 by a first key 282. The hydraulic nut 276A may be anchored to a selected one of the anchoring structures 278 by a second key 284. As is best seen in FIG. 28 the first key 282 includes a pair of downward extending legs 286 and 288 configured to be closely received in the opposed notches of one of the anchoring structures 278 defined on the rod 266A. The second key 284 is similarly constructed as seen in FIG. 29.

Figure 30C:
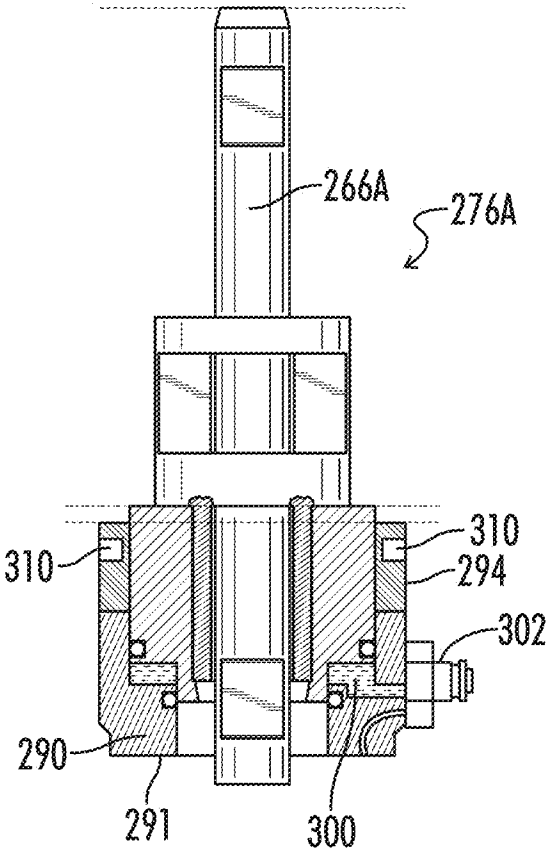
FIGS. 30A-30C are a sequential series of cross-sectional drawings of the hydraulic nut illustrating the operation of the hydraulic nut.
Figure 30B:
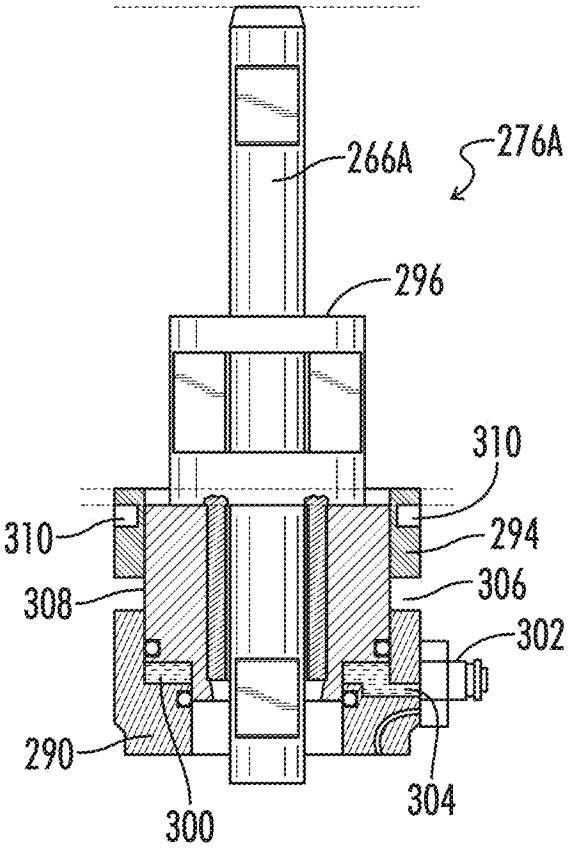
Figure 30A:
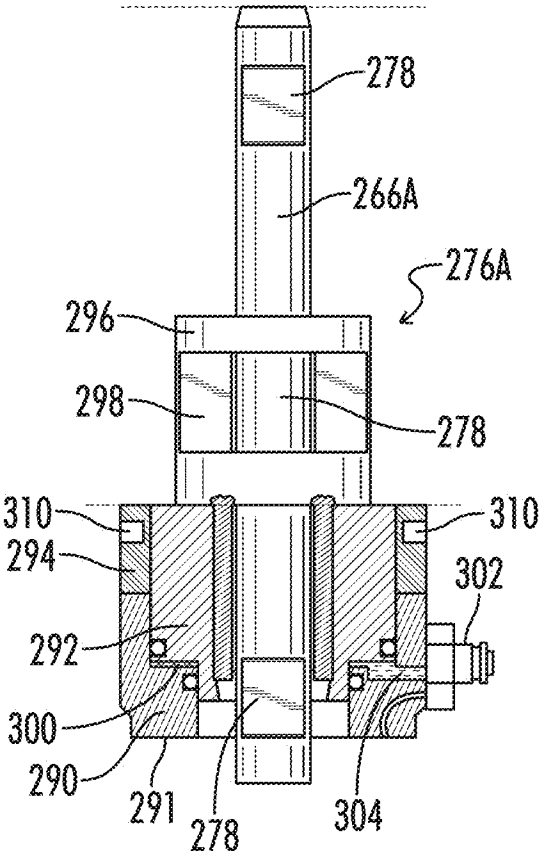
Figure 31:
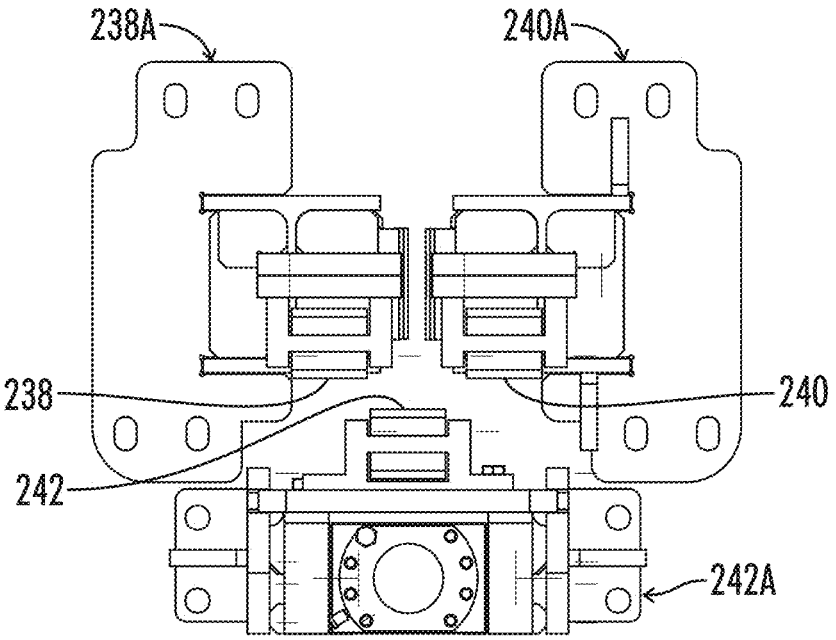
FIG. 31 is a left end elevation view showing the three roller guide mounting bases in isolation.
Figure 32:
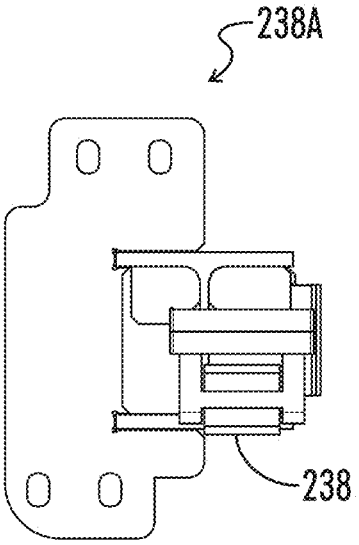
FIG. 32 is a left end elevation view showing the forward upper roller guide mounting base in isolation.
Figure 33:
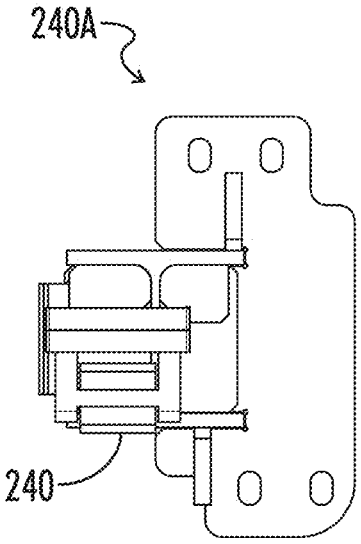
FIG. 33 is a left end elevation view showing the rearward upper roller guide mounting base in isolation.
Figure 34:
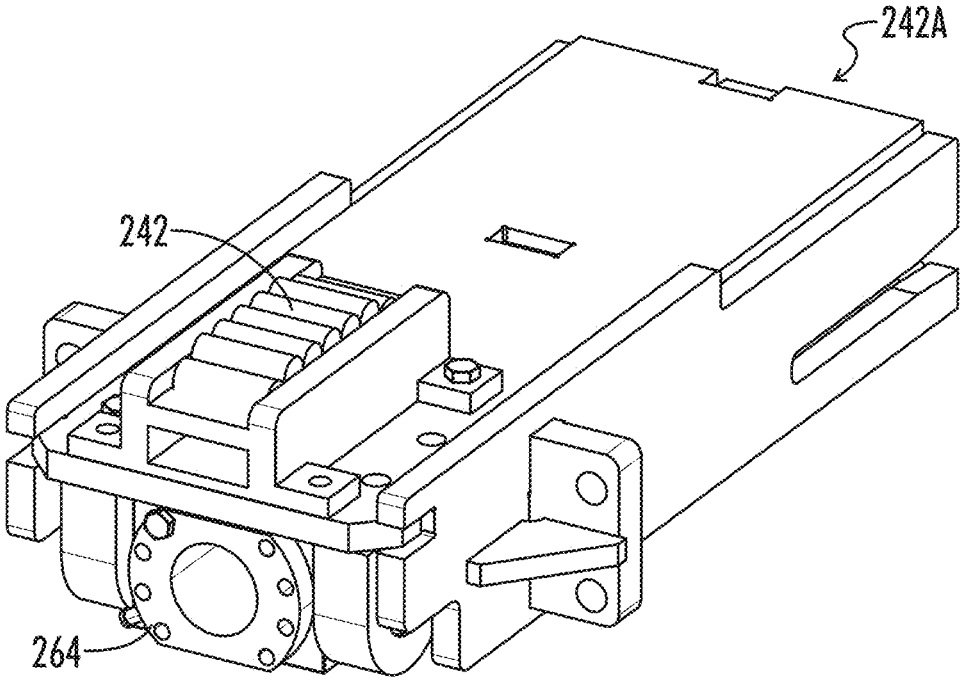
FIG. 34 is a left end perspective view showing the lower roller guide mounting base in isolation.

The operation of the hydraulic nut 276A is illustrated in the sequential series of FIGS. 30A-30C. The hydraulic nut 276A includes a cylinder 290, a piston 292 and a mechanical lock nut 294. A nut anchor 296 is fixedly attached to the piston 292 and includes a slot 298 on either side for receiving the legs of second key 284 to lock the hydraulic nut 276A in place on the hanger rod 266A.

In FIG. 30A the hydraulic nut 276A is shown in its initial position prior to applying a clamping force. An end 291 of the cylinder 290 will be located close to a laterally inner surface of the left lateral end 204 of center portion 202 as can be seen in FIG. 20B. The hanger rod 266A will have its anchoring structures 278 located thereon so as to provide an appropriate placement for the hydraulic nut 276A relative to the laterally inner surface of the left lateral end 204 of center portion 202 for different selected widths of spacers 258A, 258B, etc. And the spacers 258A, 258B, etc will preferably each have a spacer width equal to a whole number multiple of the spacing interval 280.

A pressure chamber 300 is defined between the cylinder 290 and the piston 292. An external pressure fitting 302 is communicated with pressure chamber 300 by a passage 304. A manually actuated hydraulic pump (not shown) may be attached to fitting 302 and pressure is applied to move the cylinder 290 laterally away from the piston 292 to the position shown in FIG. 30B. This is done to all four hydraulic nuts 276A-276D (see FIG. 20A) until the desired tension force has been applied to all of the hanger rods 266A-266D to clamp the spacers between the left sideform assembly 218 and the center portion 202. Note in FIG. 30B that a space 306 has opened up between the cylinder 290 and the piston 292.

The piston 292 has a threaded outer surface 308 and the mechanical lock nut 294 has a threaded inner bore which is engaged with the threaded outer surface 308. As seen in FIG. 30C, the lock nut 294 has been screwed down against the cylinder 290 to close space 306 and hold the cylinder 290 in its extended position to hold the tension force in hanger rod 266A. The lock nut 294 may be rotated by a manual tool inserted in tool fittings 310. The pressure applied to fitting 302 may now be released. FIG. 30C may be referred to a as clamped position of the hydraulic nut 276.

Figure 35:
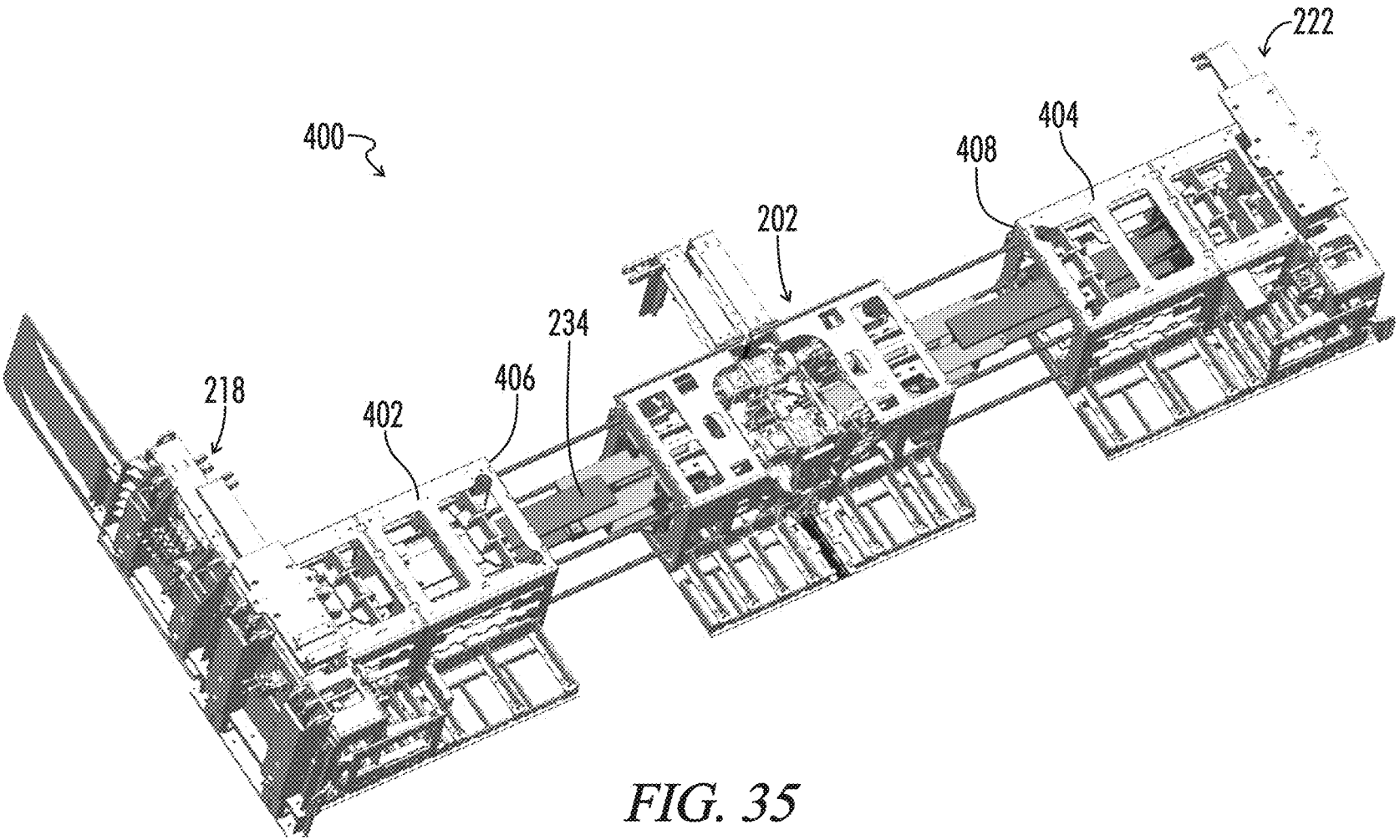
FIG. 35 is a view similar to FIG. 15, but showing a three foot extension attached to each of the sideform assemblies to increase the nominal paving width of the apparatus.

Embodiment of FIG. 35

FIG. 35 shows a modified version of the adjustable width mold apparatus of FIG. 15, which is identified by the number 400. The apparatus 400 is in most respects identical to the apparatus 200 and like numbers are used for the analogous parts.

It is noted that the apparatus 200 shown in FIG. 15 may have a nominal width of about six feet for the center portion 202 and about three feet each for the side assemblies 218 and 222, for an overall minimum paving width of about twelve feet. The adjustable width provided by the spacers 258 may add up to about three feet to each side so that the apparatus 200 may have a maximum paving width of about eighteen feet.

If it is desired to pave greater widths, and if no width less that eighteen feet needs to be paved, a three foot extension 402 and 404 may be attached to each of the sideform assemblies 218 and 222, respectively as seen in FIG. 35. The extensions 402 and 404 may be considered a permanent part of the sideform assemblies 218 and 222 in the embodiment of FIG. 35. The laterally inner end of the sideform assembly 218 is now indicated at 406, and the laterally inner end of sideform assembly 222 is indicated at 408.

The adjustable width assemblies such as 234, and the hanger rods 266A-266D, and the hydraulic spindle actuators 260 may be mounted on the respective extension 402 or 404. Now the apparatus 400 can pave widths from about eighteen feet to about twenty-four feet.

Methods of Operation of the Embodiments of FIGS. 15-35

The operation of the embodiments of FIGS. 15-35 may be described as comprising steps of:

(a) extending a linear actuator 260 to extend a sideform assembly 218 away from a center portion 202 of the mold apparatus thereby providing a space between the sideform assembly and the center portion;

(b) placing one or more spacers 258A, 258B in the space between the sideform assembly 218 and the center portion 202;

(c) retracting the linear actuator 260 and thereby moving the sideform assembly 218 toward the center portion 202 of the mold apparatus and reducing the space between the sideform assembly 218 and the center portion 202; and (d) clamping the one or more spacers 258A, 258B between the sideform assembly 218 and the center portion 202 by applying hydraulic pressure to a plurality of hydraulic nuts 276A-276D attached to a plurality of tensioning rods 266A-266D extending between the sideform assembly 218 and the center portion 202 thereby tensioning the tension rods.

The method may further include a step of after step (d), tightening a mechanical lock nut 294 on each of the hydraulic nuts 276A-276D to hold a final tensioning force on each of the tensioning rods 266A-266D, as shown in FIG. 30C.

And the method may further include a step after the tightening step, of releasing hydraulic pressure from the hydraulic nuts.

The process of adjusting the width of the paving assembly of the adjustable width mold apparatus 200 is as follows:

(a) The hydraulic spindle actuators 260 are used to move the sideform assemblies 218, 222 laterally outward away from the center portion 202 to provide sufficient space for receiving the spacers 258. During the expansion motion the support rods 266A-266D with their rod anchors 274 and hydraulic nuts 276 remain in place and the first and/or second keys 282, 284 are removed so that the support rods do not interfere with the expansion motion.

(b) Then the spacers 258A, 258B, etc are hung on the support rods 266A-266D.

(c) Next the hydraulic spindle actuators 260 retract the sideform assemblies 218, 222 until the spacers 258 are snugly received between the sideform assemblies 218, 222 and the center portion 202, but the hydraulic spindle actuators 260 are not used to clamp the spacers 258 in place.

(d) Now the hydraulic pressure to the hydraulic spindle actuators 260 is released. In this way the hydraulic spindle actuators 260 will not be subjected to the subsequent compression forces applied by the hydraulic nuts 276 as described below, which would be undesirable.

(e) The keys 282 are replaced on the rod anchors 274 (if they have been removed) and the support rods 266A-266D are pulled inward until the rod anchor 274 on the outer end of each support rod is pulled into engagement with a supporting surface of the respective sideform assembly. Then the laterally inner keys 284 are replaced so that the hydraulic nuts 276 are fixed to one of the anchoring structures 278 as close as possible to the inner face of the laterally outer end 204, 206 of the center portion 202. With reference to FIGS. 30A-30C, the piston 292 of the hydraulic nut 276 is fixed to the support rod 266 by the key 284. The key 284 actually engages the nut anchor 296 which is attached to the piston 292.

(f) Hydraulic pressure is now applied to each of the hydraulic nuts 276 to place tension on each of the support rods 266A-266D thus applying a tension force to the support rods 266A-266D that initially clamps the spacers 258 between the sideform assemblies 218, 222 and the center portion 202. The application of hydraulic pressure to the hydraulic nuts 276 can be done simultaneously or sequentially. The hydraulic nuts 276 can only apply a force urging the sideform assemblies 218, 222 toward the center portion 202. The hydraulic nuts 276 cannot move the sideform assemblies 218, 222 away from the center portion 202.

(g) Then the mechanical lock nuts 294 are adjusted on each hydraulic nut 276 so that the piston 292 of each hydraulic nut 276 is locked in its extended position to hold tension on the respective support rod 266A-266D.

(h) Then hydraulic pressure is released from the hydraulic nuts 276 and the long-term compressive force on the spacers 258 is maintained by the tension that is held in the support rods 266A-266D by the mechanical lock nuts 294.

Thus it is seen that the apparatus and methods of the embodiments disclosed herein readily achieve the ends and advantages mentioned as well as those inherent therein. While certain preferred embodiments have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. An adjustable width mold apparatus for a slipform paver, the mold apparatus comprising:

a center portion;

a left sideform assembly;

a right sideform assembly;

a left adjustable width support assembly connected between the left sideform assembly and the center portion;

a left actuator for extending and retracting the left adjustable width support assembly;

a right adjustable width support assembly connected between the right sideform assembly and the center portion;

a right actuator for extending and retracting the right adjustable width support assembly;

a plurality of left side hanger rods extending between the left sideform assembly and the center portion;

one or more left side spacers configured to be received on the left side hanger rods between the left sideform assembly and the center portion; and a plurality of hydraulic nuts, each hydraulic nut being attached to a respective one of the hanger rods and configured to apply a clamping force to clamp the one or more left side spacers between the left sideform assembly and the center portion.

2. The mold apparatus of claim 1, wherein the plurality of left side hanger rods includes:

a forward upper hanger rod;

a forward lower hanger rod;

a rearward upper hanger rod; and a rearward lower hanger rod.

3. The mold apparatus of claim 1, wherein:

each of the hanger rods includes a plurality of anchoring structures equally spaced at a spacing interval along a length of the hanger rod.

4. The mold apparatus of claim 3, wherein:

each of the one or more left side spacers has a spacer width equal to a whole number multiple of the spacing interval.

5. The mold apparatus of claim 3, wherein:

each of the anchoring structures includes a pair of diametrically opposed notches formed in the respective hanger rod.

6. The mold apparatus of claim 3, wherein:

each of the hydraulic nuts includes a nut anchor configured to be engaged with one of the anchoring structures of the respective hanger rod.

7. The mold apparatus of claim 3, further comprising:

a plurality of end anchors, each of the end anchors being engaged with one of the anchoring structures of a respective one of the hanger rods.

8. The mold apparatus of claim 1, wherein:

each of the hydraulic nuts includes a manual lock nut configured to lock the hydraulic nut in a clamped position so that hydraulic pressure to the hydraulic nut can be released while maintaining the hydraulic nut in the clamped position.

9. The mold apparatus of claim 1, wherein the left adjustable width support assembly comprises:

an I-beam fixedly connected to one of the left sideform assembly and the center portion; and a plurality of roller guides mounted on the other of the left sideform assembly and the center portion, the I-beam being slidingly received by the plurality of roller guides.

10. The mold apparatus of claim 9, wherein:

the I-beam is fixedly connected to the left sideform assembly; and the plurality of roller guides are mounted on the center portion.

11. The mold apparatus of claim 10, wherein:

the center portion terminates in left and right lateral ends;

the left adjustable width support assembly includes a plurality of separate roller guide mounting bases mounted on the left lateral end of the center portion, each of the roller guides being mounted on one of the roller guide mounting bases; and a laterally innermost one of the one or more left spacers surrounds the roller guide mounting bases such that the laterally innermost one of the one or more left spacers is held directly against the left lateral end of the center portion.

12. The mold apparatus of claim 11, wherein:

each of the roller guide mounting bases extends laterally inward of the left lateral end of the center portion into the center portion.

13. The mold apparatus of claim 12, wherein:

the left adjustable width support assembly is configured such that when no spacers are present and the left actuator is retracted such that the left sideform assembly is pulled into engagement with the left lateral end of the center portion the I-beam extends through the left lateral end of the center portion into the center portion.

14. The mold apparatus of claim 9, wherein:

the I-beam includes a top flange, a bottom flange, and a vertical central web joining the top flange and the bottom flange; and the plurality of roller guides includes:

an outer roller guide engaging an outer surface of one of the top and bottom flanges directly in line with the vertical central web; and first and second inner roller guides engaging inner surfaces of the one of the top and bottom flanges, the first and second inner roller guides being located on opposite sides of the vertical central web.

15. The mold apparatus of claim 1, wherein:

the left actuator is a rotary spindle actuator including a left rotary spindle connected to one of the left sideform assembly and the center portion, and a left spindle nut connected directly or indirectly to the other of the left sideform assembly and the center portion, the left rotary spindle being received in the left spindle nut.

16. A method of adjusting a width of a mold apparatus of a slipform paver, the method comprising:

(a) extending a linear actuator to extend a sideform assembly away from a center portion of the mold apparatus thereby providing a space between the sideform assembly and the center portion;

(b) placing one or more spacers in the space between the sideform assembly and the center portion;

(c) retracting the linear actuator and thereby moving the sideform assembly toward the center portion of the mold apparatus and reducing the space between the sideform assembly and the center portion; and (d) clamping the one or more spacers between the sideform assembly and the center portion by applying hydraulic pressure to a plurality of hydraulic nuts attached to a plurality of tensioning rods extending between the sideform assembly and the center portion thereby tensioning the tension rods.

17. The method of claim 16, further comprising:

after step (d), tightening a mechanical lock nut on each of the hydraulic nuts to hold a final tensioning force on each of the tensioning rods.

18. The method of claim 17, further comprising:

after the tightening step, releasing hydraulic pressure from the hydraulic nuts.

19. The method of claim 16, wherein:

in step (a) the linear actuator is a hydraulic actuator.

20. The method of claim 19, further comprising:

hydraulically releasing the hydraulic actuator.

21. The method of claim 16, wherein:

in step (a) the linear actuator is a rotary spindle actuator including a rotary spindle connected to one of the sideform assembly and the center portion, and a spindle nut connected to the other of the sideform assembly and the center portion.

22. The method of claim 16, wherein:

in step (a) the center portion terminates in left and right lateral ends;

in step (a) the sideform assembly is at least partially supported by a adjustable width support assembly extending through one of the lateral ends of the center portion; and in step (d) a laterally innermost one of the one or more spacers is clamped directly against the one of the lateral ends of the center portion.

23. The method of claim 16, wherein:

in step (b) the one or more spacers are supported on the tensioning rods.

24. The method of claim 23, wherein:

in step (d) the plurality of tensioning rods includes:

a forward upper tensioning rod;

a forward lower tensioning rod;

a rearward upper tensioning rod; and a rearward lower tensioning rod.

* * * * *